US009382703B2

(12) United States Patent
Quinn et al.

(10) Patent No.: US 9,382,703 B2
(45) **Date of Patent: *Jul. 5, 2016**

(54) SYSTEMS AND METHODS FOR CONSTRUCTING TEMPORARY, RE-LOCATABLE STRUCTURES

(71) Applicants: Premium Steel Building Systems, Inc., Roanoke, VA (US); Insular, Corp., Arnold, MD (US)

(72) Inventors: James G. Quinn, Arnold, MD (US); E. Danny Feazell, Huddleston, VA (US); Gary N. Feazell, Moneta, VA (US)

(73) Assignees: Premium Steel Building Systems, Inc., Roanoke, VA (US); Insular Corp., Arnold, MD (US)

( * ) Notice: Subject to any disclaimer, the term of this patent is extended or adjusted under 35 U.S.C. 154(b) by 21 days.

This patent is subject to a terminal disclaimer.

(21) Appl. No.: 14/748,689

(22) Filed: Jun. 24, 2015

(65) Prior Publication Data

US 2015/0322668 A1 Nov. 12, 2015

Related U.S. Application Data

(63) Continuation-in-part of application No. 13/966,483, filed on Aug. 14, 2013, now Pat. No. 9,068,372.

(60) Provisional application No. 61/683,026, filed on Aug. 14, 2012.

(51) Int. Cl.
*E04B 1/343* (2006.01)
*E04B 1/02* (2006.01)
(Continued)

(52) U.S. Cl.
CPC ..... *E04B 1/34321* (2013.01); *E04B 1/02* (2013.01); *E04B 1/24* (2013.01); *E04B 1/34326* (2013.01);
(Continued)

(58) Field of Classification Search
CPC ... E04B 1/34321; E04B 1/34342; E04B 1/02; E04B 1/34326; E04B 1/34384; E04B 1/40; E04B 1/61; Y10S 52/03; E04H 1/02
USPC ..... 52/DIG. 3, 23, 236.9, 281
See application file for complete search history.

(56) References Cited

U.S. PATENT DOCUMENTS 2,142,305 A 1/1939 Davis
3,210,903 A * 10/1965 Herolf ..... E04B 1/35 264/31

(Continued)

FOREIGN PATENT DOCUMENTS

DE 2525758 A1 * 12/1976 ..... E04B 1/24
DE 3729462 A1 * 3/1989 ..... E04B 1/34321

(Continued)

OTHER PUBLICATIONS

PCT Patentabilty Report for PCT/US2012/039683 dated Nov. 26, 2013.

(Continued)

*Primary Examiner* — Charles A Fox
*Assistant Examiner* — Joseph J Sadlon
(74) *Attorney, Agent, or Firm* — Remenick PLLC

(57) ABSTRACT

A system for constructing a reassemblable structure is disclosed. The system comprises a plurality of wall panels, a plurality of roof panels, a plurality of floor panels, at least one readjustable support device adapted to be adjusted to multiple positions, a plurality of skirt panels coupled below at least one floor panel and supported by the at least one readjustable support device, a plurality of load-bearing members coupled to the wall panels, a plurality of load-bearing members coupled to the wall skirt panels, at least one floor support suspended between two load-bearing members coupled to the skirt panels and supporting the plurality of floor panels, and at least one roof support suspended between two load-bearing members coupled to the wall panels and supporting the plurality of roof panels

21 Claims, 31 Drawing Sheets

(51) Int. Cl.

| | |
|---|---|
| ***E04B 1/41*** | (2006.01) |
| ***E04B 1/61*** | (2006.01) |
| ***E04H 1/02*** | (2006.01) |
| ***E04B 1/24*** | (2006.01) |
| *E04H 1/12* | (2006.01) |
| *E04B 1/38* | (2006.01) |
| *E02D 27/00* | (2006.01) |
| *E04C 3/08* | (2006.01) |
| *E04C 3/04* | (2006.01) |

(52) U.S. Cl.

CPC ..... *E04B 1/34384* (2013.01); *E04B 1/40* (2013.01); *E04B 1/61* (2013.01); *E04H 1/02* (2013.01); *E02D 27/00* (2013.01); *E04B 1/34315* (2013.01); *E04B 2001/2463* (2013.01); *E04B 2001/2481* (2013.01); *E04B 2001/2484* (2013.01); *E04B 2001/34389* (2013.01); *E04B 2001/405* (2013.01); *E04C 3/08* (2013.01); *E04C 2003/0491* (2013.01)

(56) References Cited

U.S. PATENT DOCUMENTS

| | | | | |
|---|---|---|---|---|
| 3,400,958 | A | 9/1968 | Haimes et al. | |
| 3,608,928 | A * | 9/1971 | Hooker | B60P 3/36 280/768 |
| 3,641,720 | A * | 2/1972 | Berrie | E04B 1/14 52/126.4 |
| 3,716,267 | A * | 2/1973 | Lindsay | E04B 1/34342 296/168 |
| 3,722,156 | A * | 3/1973 | Bryant | B60P 3/36 52/155 |
| 3,949,532 | A * | 4/1976 | Jonsson | E04B 1/14 52/270 |
| 3,992,839 | A | 11/1976 | La Borde | |
| 4,284,447 | A | 8/1981 | Dickens et al. | |
| 4,288,951 | A | 9/1981 | Carlson et al. | |
| 4,404,889 | A | 9/1983 | Miguel | |
| 4,435,939 | A | 3/1984 | Hird | |
| 4,458,462 | A | 7/1984 | Schold | |
| 4,534,141 | A | 8/1985 | Fagnoni | |
| 4,780,039 | A | 10/1988 | Hartman | |
| 4,822,657 | A | 4/1989 | Simpson | |
| 4,953,334 | A | 9/1990 | Dickens | |
| 5,014,478 | A | 5/1991 | Spring | |
| 5,060,582 | A | 10/1991 | Salzer | |
| 5,083,410 | A | 1/1992 | Watson | |
| 5,165,816 | A | 11/1992 | Parasin | |
| 5,185,195 | A | 2/1993 | Harpell et al. | |
| 5,257,583 | A | 11/1993 | Koenig | |
| 5,370,034 | A | 12/1994 | Turner et al. | |
| 5,469,796 | A | 11/1995 | Koenig | |
| 5,479,749 | A * | 1/1996 | Colasanto | E04B 1/24 52/236.8 |
| 5,502,939 | A | 4/1996 | Zadok et al. | |
| 5,596,844 | A | 1/1997 | Kalinowski | |
| 5,724,782 | A | 3/1998 | Rice et al. | |
| 5,758,461 | A | 6/1998 | McManus | |
| 5,767,435 | A | 6/1998 | Reymann | |
| 5,799,462 | A | 9/1998 | McKinney | |
| 5,966,956 | A | 10/1999 | Morris et al. | |
| 5,970,675 | A | 10/1999 | Schray | |
| 6,035,584 | A | 3/2000 | Barreto | |
| 6,082,240 | A | 7/2000 | Middione et al. | |
| 6,253,498 | B1 | 7/2001 | Fanucci | |
| 6,339,905 | B1 | 1/2002 | Craig | |
| 6,408,594 | B1 | 6/2002 | Porter | |
| 6,532,857 | B1 | 3/2003 | Shih et al. | |
| 6,591,564 | B2 * | 7/2003 | Cusimano | E02D 27/01 248/156 |
| 6,604,328 | B1 * | 8/2003 | Paddock | E04B 1/34315 52/264 |
| 6,647,689 | B2 | 11/2003 | Pletzer et al. | |
| 6,826,996 | B2 | 12/2004 | Strait | |
| 6,945,064 | B2 | 9/2005 | Jebaraj | |
| 7,086,209 | B1 | 8/2006 | Pruitt et al. | |
| 7,117,645 | B2 | 10/2006 | Bzorgi | |
| 7,520,205 | B1 | 4/2009 | Colliflower et al. | |
| 7,818,939 | B2 | 10/2010 | Bearinger et al. | |
| 7,882,659 | B2 | 2/2011 | Gyory et al. | |
| 7,966,775 | B2 | 6/2011 | Medley | |
| 8,136,303 | B2 | 3/2012 | Scott, IV | |
| 8,146,314 | B2 * | 4/2012 | Nguyen | E04B 1/08 52/241 |
| 8,156,690 | B2 | 4/2012 | Higley | |
| 8,291,647 | B2 * | 10/2012 | Esposito | E04B 1/34331 52/11 |
| 9,062,450 | B2 * | 6/2015 | Philibert | E04B 1/34321 |
| 2004/0020989 | A1 | 2/2004 | Muramatsu | |
| 2004/0052999 | A1 | 3/2004 | Rogers | |
| 2005/0063780 | A1 | 3/2005 | Thorne | |
| 2006/0117689 | A1 | 6/2006 | Onken et al. | |
| 2007/0039262 | A1 | 2/2007 | Forgy | |
| 2007/0144090 | A1 | 6/2007 | Nguyen | |
| 2008/0083180 | A1 | 4/2008 | Miller | |
| 2008/0271402 | A1 * | 11/2008 | Gingras | E04B 1/34321 52/506.02 |
| 2009/0188181 | A1 | 7/2009 | Forbis et al. | |
| 2009/0223144 | A1 | 9/2009 | Leahy | |
| 2009/0272060 | A1 | 11/2009 | Lucchesi | |
| 2010/0154331 | A1 | 6/2010 | Dickens | |
| 2010/0236594 | A1 * | 9/2010 | Hammann | E04H 1/1205 135/143 |
| 2010/0319285 | A1 | 12/2010 | Jewett et al. | |
| 2010/0325971 | A1 | 12/2010 | Leahy | |
| 2010/0325989 | A1 | 12/2010 | Leahy | |
| 2011/0000014 | A1 | 1/2011 | Ball et al. | |
| 2011/0047912 | A1 | 3/2011 | Armijo | |
| 2011/0061336 | A1 * | 3/2011 | Thomas | B66C 23/342 52/745.19 |
| 2011/0132421 | A1 | 6/2011 | Dolsby et al. | |
| 2011/0154761 | A1 | 6/2011 | Quinn | |
| 2011/0179745 | A1 | 7/2011 | Herron | |

FOREIGN PATENT DOCUMENTS

| | | | |
|---|---|---|---|
| EP | 1333129 | 8/2003 | |
| FR | 2979363 A1 * | 3/2013 | E04B 1/34321 |
| GB | 2478907 | 9/2011 | |

OTHER PUBLICATIONS

PCT Search Report for PCT/US2013/054843, dated Feb. 5, 2014.

PCT Search Report for PCT/US2004/020989 dated Jul. 28, 2005.

PCT Patentabilty Report for PCT/US2004/020989 dated Jul. 28, 2005.

PCT Patentability Report for PCT/US2013/054843, dated Feb. 5, 2014.

* cited by examiner

TOP END

TOP VIEW

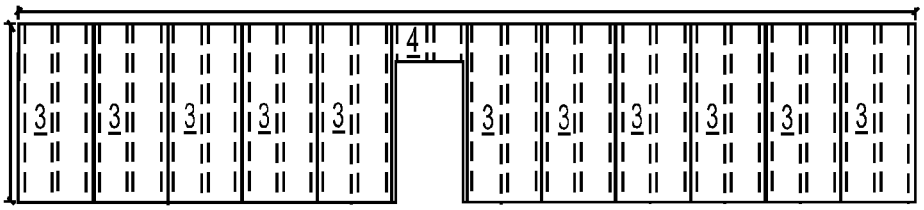
FIG. 18A
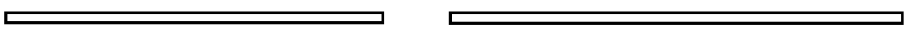
FIG. 18B
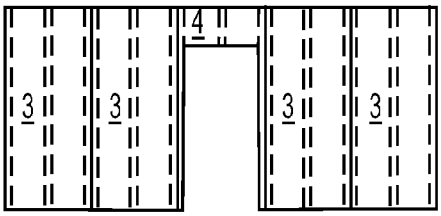
FIG. 19A
FIG. 19B
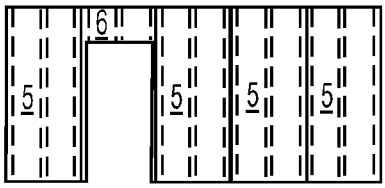
FIG. 20A
FIG. 20B

FLOOR PANEL LAYOUT

ROOF PANEL LAYOUT

FOUNDATION PANEL LAYOUT

SECTION @ WALL PANEL JOINTS

SUPPORT PANEL LAYOUT

ADJUSTABLE STRUCTURE SUPPORT

SYSTEMS AND METHODS FOR CONSTRUCTING TEMPORARY, RE-LOCATABLE STRUCTURES

REFERENCE TO RELATED APPLICATIONS

This application is a continuation-in-part of U.S. application Ser. No. 13/966,483, filed Aug. 14, 2013 and entitled "Systems and Methods for Constructing Temporary, Re-locatable Structures," which claims priority to U.S. Provisional Application Ser. No. 61/683,026, filed Aug. 14, 2012, and entitled "Systems and Methods for Constructing Temporary, Re-locatable Structures," both of which are hereby specifically and entirely incorporated by reference.

BACKGROUND

1. Field of the Invention

The invention is directed to systems and methods of constructing temporary or re-locatable structures and, in particular, systems and methods of constructing temporary structures to be energy efficient using insulated panels.

2. Background of the Invention

Global warming, high energy costs, lack of reusable sources of energy, and diminishing resources of fossil fuels are all reasons, among others, to improve the energy efficiency of structures. Traditional temporary structures, such as tents, collapsible fabric or metal structures, or plastic structures, are usually energy inefficient, losing hot and/or cool air though the various surfaces, walls, roofs, windows, doors, gaps, and other components.

In order to improve the energy efficiency of these temporary buildings it is often necessary to retrofit the building with energy efficient materials, for example with spray-on insulation. Such upgrading is costly, time consuming, and can ruin the structure or prevent it from being re-locatable. Furthermore, existing temporary structures often are difficult to assemble, having multiple parts that must be sorted, organized and installed.

Therefore, it is desirable to have systems and methods of constructing a temporary structure that is cost effective, easy to install, and provides energy efficiency.

SUMMARY OF THE INVENTION

The present invention overcomes the problems and disadvantages associated with current strategies and designs and provides new systems and methods of constructing temporary or re-locatable structures.

One embodiment of the invention is directed to a system for constructing a temporary structure. The system comprises a plurality of wall panels, a plurality of roof panels, a plurality of floor panels, at least one adjustable support structure, at least one sub-floor truss supporting the plurality of floor panels and placed atop the at least one adjustable support structure, at least one sub-roof truss supporting the plurality of roof panels, and at least one floor coupling bracket, each floor coupling bracket coupling one wall panel, one floor panel, and one sub-floor truss.

Preferably, the system further comprises at least one tie-down coupled to the structure. In a preferred embodiment, the wall panels, the roof panels, and the floor panels are identical. The system preferably further comprises a coating on the surface of at least one panel. Preferably, the system is adapted to be assembled and disassembled into the original components on location. Preferably, the system is adapted to be re-located and reassembled after being disassembled.

In a preferred embodiment, the system further comprises at least one of screws, adhesive, rivets, bolts, or nails to adjoin panels. Preferably, the structure is a multi-story structure. Preferably, the roof panels of the first story are the floor panels of the second story. In a preferred embodiment, the system further comprises level coupling brackets coupling a lower level to an upper level.

Preferably, each panel is insulated and fire retardant. Preferably there is at least one entranceway panel. In a preferred embodiment, the system preferably further comprises interior wall panels, wherein the interior wall panels divide the structure into a plurality of rooms. Preferably, each panel is reinforced with at least one steel stud. Preferably, adjacent panels are coupled together with shiplap joints. Preferably, the system further comprises a foundation panel below the at least one floor truss.

Preferably, the entire system is arrangeable within a single shipping container. Preferably, the system further comprises at least one support panel or at least one skirt panel coupled to the at least one floor truss and below the plurality of floor panels. Preferably, at least a portion of the panels are pre-drilled to accept a screw. Preferably, multiple structures are arranged side-by-side to create a larger structure.

Other embodiments and advantages of the invention are set forth in part in the description, which follows, and in part, may be obvious from this description, or may be learned from the practice of the invention.

DESCRIPTION OF THE DRAWINGS

The invention is described in greater detail by way of example only and with reference to the attached drawings, in which:

FIGS. 17-30 depict different views of an embodiment of a one story relocatable structure.

DESCRIPTION OF THE INVENTION

As embodied and broadly described herein, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention.

A problem in the art capable of being solved by the embodiments of the present invention is constructing a temporary, re-locatable structure that is energy efficient. It has been surprisingly discovered that by using interlocking brackets and insulating panels an energy efficient temporary structure can be constructed more easily and quickly than a traditional temporary structure.

Figure 1A:
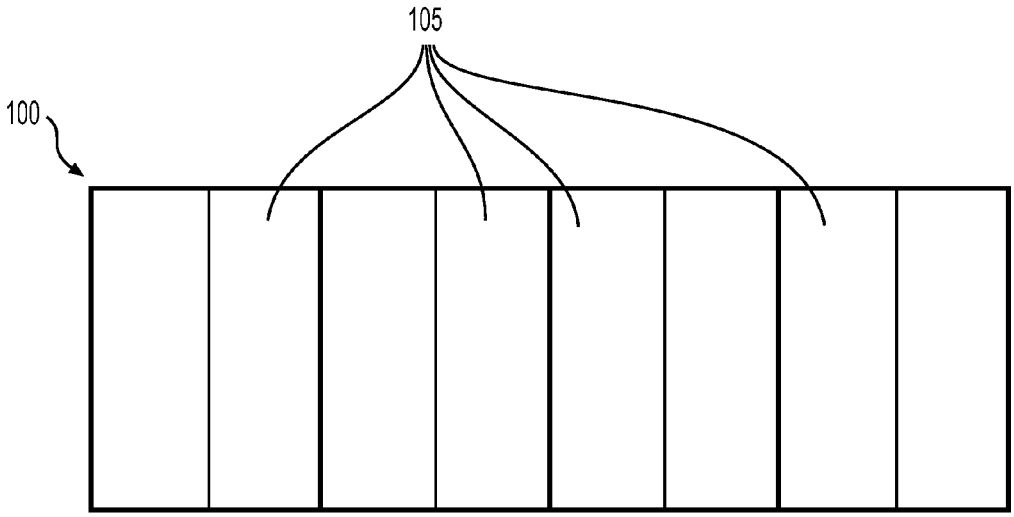
FIG. 1A depicts an embodiment of a wall of side panels.
Figure 1B:
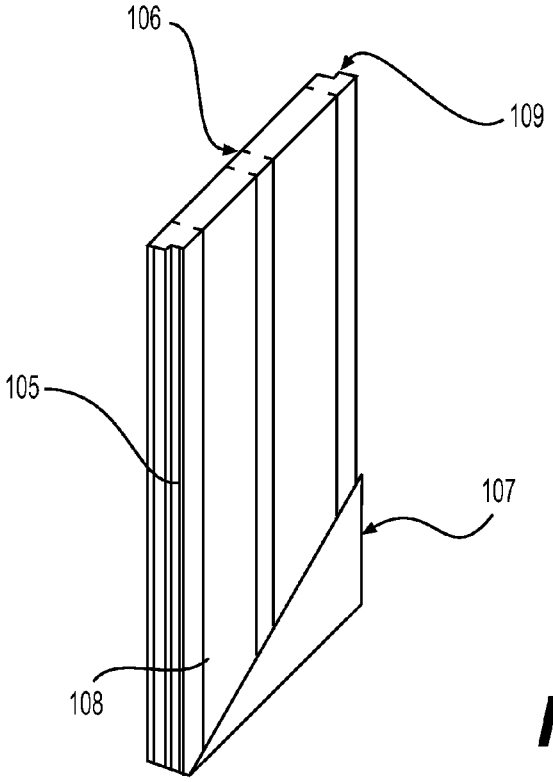
FIG. 1B depicts a perspective view of a wall panel.

FIG. 1A depicts an exemplary exterior wall 100. In the preferred embodiment, wall 100 is comprised of a plurality of panels 105. FIG. 1B depicts a perspective view of an embodiment of a wall panel 105. As shown in FIGS. 1A-B, panels 105 are 8 feet wide by 8.5 feet tall; however other size panels can be used. Preferably each panel 105 is comprised of a polystyrene (e.g. Neopor or Styropor) core; however, other insulating materials such as, but not limited to, fiberglass, urea-formaldehyde, cellulous, and polyethylene can be used. The thickness and foam density may vary due to specific requirements. Wall panel 105 may further include varying gauge steel studs 109 Additionally, panels 105 may be coated with FRP (fiberglass reinforced plastic) boards, film coverings (e.g. graphical image film coverings or heat dissipating film coverings), spray coatings (e.g. insulating spray coatings or fire retardant spray coatings), Strongwell's Safe Plates, or other materials. Panels 105 are preferably also made of a fire retardant material, such as fireboard 108. Preferably, panels 105 have a thickness of either 3.5 inches, 5.5 inches, or 7.5 inches; however other thicknesses are possible. Each panel 105 may additionally have one or more steel studs formed therein. The steel studs can be of varying gauge, depending on the use of the panel. In the preferred embodiment, panels 105 weigh no more than 1.625 pounds per square foot; however other weights are possible. In a preferred embodiment, there is an exterior steel skin with a PVC coating 106 and an interior steel skin with a PVC coating 107.

Figure 43:
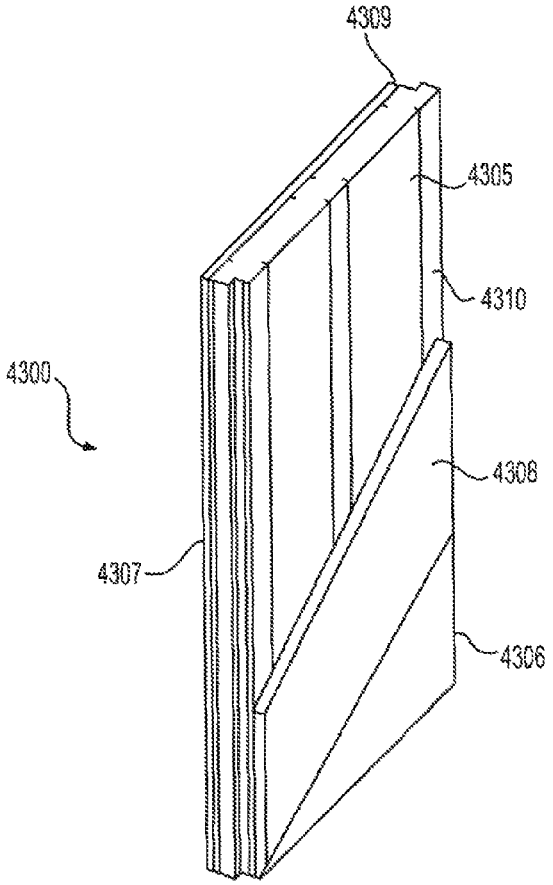
FIG. 43 depicts an embodiment of fire rated wall panel.

FIG. 43 depicts an embodiment of a Fire Rated wall panel 4300. Wall panel 4300 is preferably 10 feet by 6 feet, but can have another dimension. Preferably, wall panel 4300 is comprises of a polystyrene (e.g. Neopor or Styropor) core 4305; however, other insulating materials such as, but not limited to, fiberglass, urea-formaldehyde, cellulous, and polyethylene can be used. The thickness and foam density may vary due to specific requirements. Preferably, an interior surface of panel 4300 has a fireproof material, for example fireboard 4308, coupled thereto. The interior surface of panel 4300 is preferably faced with a steel skin 4306 having a PVC finish. However, other surfaces can be used, for example, wood, other metals, other plastics, plaster board, fabrics, or combinations thereof. The exterior surface of panel 4300 is preferably coated with a magnesium oxide board 4309 and faced with a steel skin 4307 having a PVC finish. Each panel 4300 may additionally have one or more steel studs 4310 formed therein. The steel studs 4310 can be of varying gauge, depending on the use of the panel.

Figure 44A:
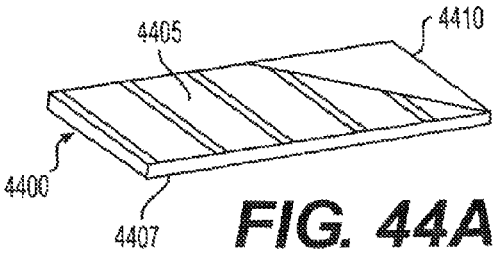
FIGS. 44A-B depict embodiments of floor and roof panels, respectively.
Figure 44B:
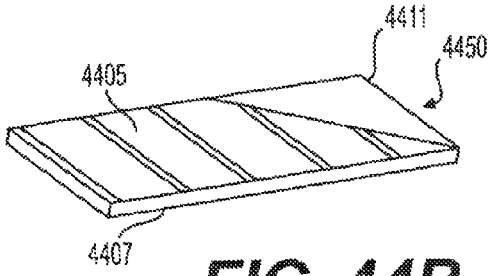

FIG. 44A depicts an embodiment of a floor panel 4400 while FIG. 44B depicts an embodiment of a roof panel 4450. Preferably both floor panel 4400 and roof panel 4450 are comprised of a polystyrene (e.g. Neopor or Styropor) core 4405; however, other insulating materials such as, but not limited to, fiberglass, urea-formaldehyde, cellulous, and polyethylene can be used. The thickness and foam density may vary due to specific requirements. Preferably, both floor panel 4400 and roof panel 4450 has one or more steel studs formed therein. The steel studs can be of varying gauge, depending on the use of the panel. Preferably, one surface of each of panel 4400 and roof panel 4450 is coated with a steel skin 4307 with a PVC finish. Floor panel 4400 preferably has a second surface that is coated with a diamond embossed aluminum plate 4410. However, other durable, non-skid surfaces can be used. Roof panel 4450 preferably has a second surface that is coated with a steel skin 4411. However, other durable, water resistant surfaces can be used.

Figure 2:
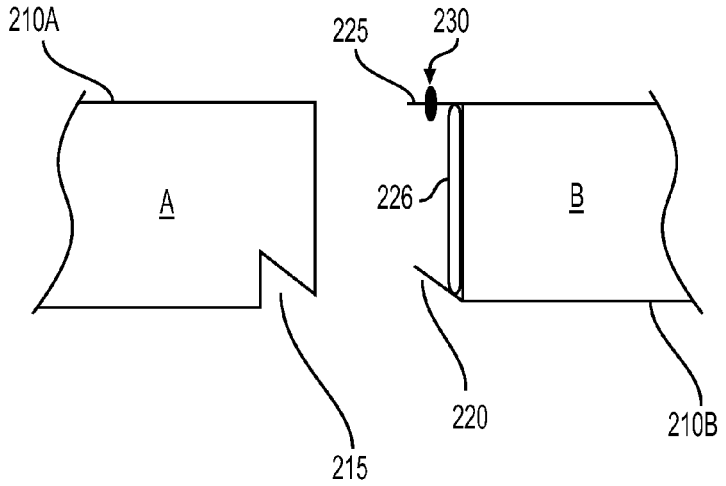
FIG. 2 depicts an embodiment of interlocking tracks.

FIG. 2 depicts exemplary interlocking tracks 210A (labeled A in the figures) and 210B (labeled B in the figures). In the preferred embodiment, each panel 105 has one track 210A coupled to a first edge and one track 210B coupled to a second, parallel edge. In the preferred embodiment, tracks 210A and 210B are coupled to the long sides of panels 105, however, depending on the structure, the short sides of panels 105 can be coupled to tracks 210A and 210B. Furthermore, in certain embodiments each panel can have two tracks 210A and two tracks 210B. Preferably in embodiments with tracks on each edge of the panel 105, the two tracks 210A are adjacent to each other and the two tracks 210B are adjacent to each other such that opposing edges have different tracks.

Track 210A has indented or recessed portion 215 along its outer edge, into which angled hemmed tab 220 of track 210B mates. On the opposite edge of track 210B from angled hemmed tab 220 is straight hemmed tab 225. As can be seen from FIG. 2, both angled and straight hemmed tabs 220 and 225 extend from the outer edge of track 210B. In a preferred embodiment a foam seal 226 or other insulation is placed between track 210A and track 210B as they are coupled. Furthermore, in a preferred embodiment, a fastener 230 (for example, a turn polycarbonate fastener, a rivet, a bolt, a screw, a brad, glue, adhesive, double-stick tape, or another fastener) is used to secure track 210A to track 210B once the two tracks are coupled together. Both tracks 210A and 210B are preferably made of 20 or 24 gage steel, however other materials can be used.

Figure 3:
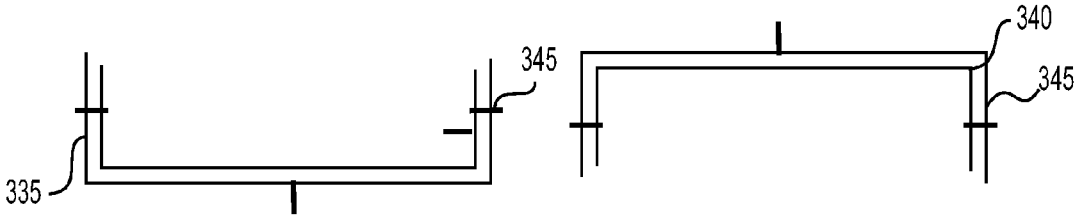
FIG. 3 depicts an embodiment of top and bottom tracks.

FIG. 3 depicts an embodiment of bottom tracks 335 and top tracks 340. In a preferred embodiment, bottom track 340 is coupled to the bottom edge of each panel 105 and top track 340 is coupled to the top edge of each panel 105. Preferably, both bottom track 335 and top track 340 are "C" shaped double tracks. Bottom track 335 and top track 340 preferably couple to panel 105 with fasteners 345 (for example, a turn polycarbonate fastener, a rivet, a bolt, a screw, a brad, glue, adhesive, double-stick tape, or another fastener). Bottom track 335 and top track 340 preferably also couple to the floor and roof with fasteners.

Figure 4:
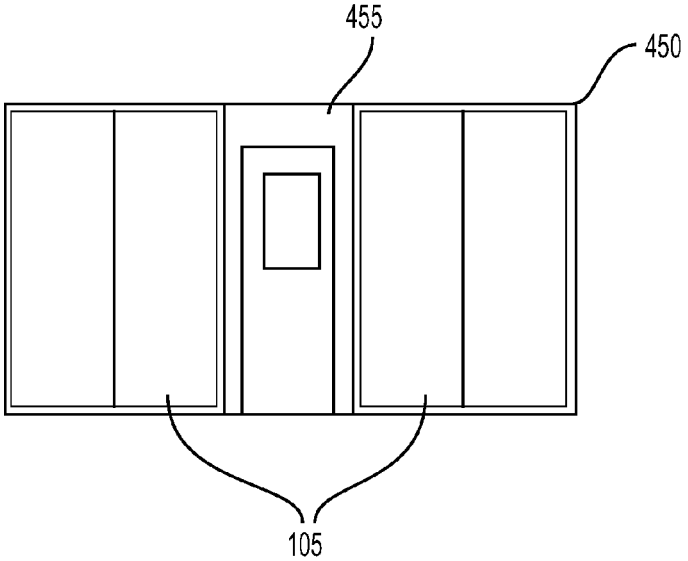
FIG. 4 depicts another embodiment of a wall of side panels.

FIG. 4 depicts another embodiment of an exterior wall 450. The exterior wall for example may be comprised of two panels 105 and entrance 455. Another number of panels 105 and entrances 455 can be used in any order. Entrance 455 is preferably made of the same material as panels 105, however, entrance 455 also includes a door or other entranceway. In FIG. 4, entrance 455 is shown as 4 feet wide by 8.5 feet tall, however another size panel can be used. Preferably, entrance 455 has the same height as panels 105.

Figure 5:
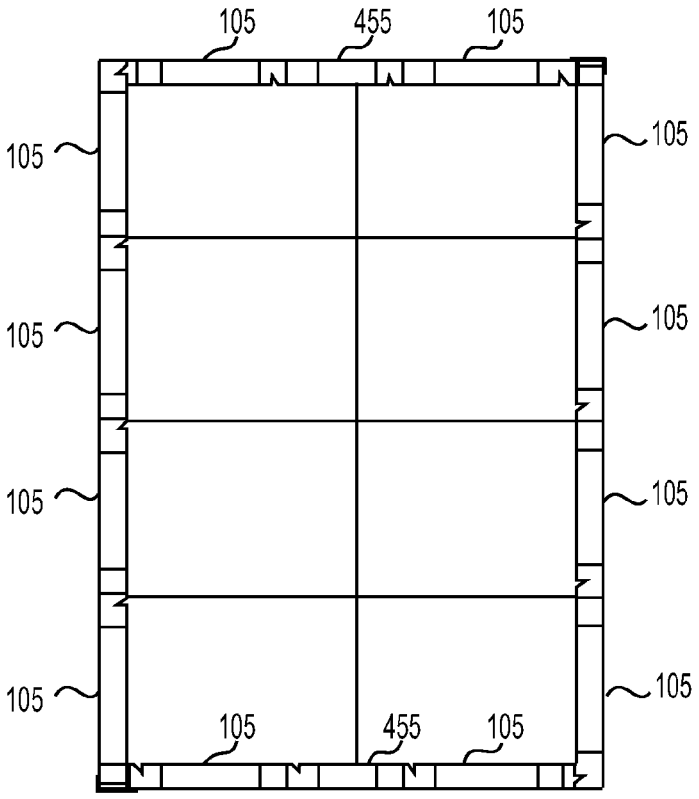
FIG. 5 depicts a plan for an embodiment of a temporary structure.

FIG. 5 depicts an example of a temporary structure floor plan. As can be seen in the figure, the floor plan is a rectangular structure having two parallel long walls made up of four panels 105 each and two parallel short walls made up of two panels 105 and one entrance 455 each. The configuration shown in FIG. 5 is merely exemplary and another number of panels 105 and entrances 455 can be used to define the structure. Additionally, structures can be assembled in multiples or stacked as needed. Furthermore, structures need not be rectangular, but can have another shape.

Figure 6:
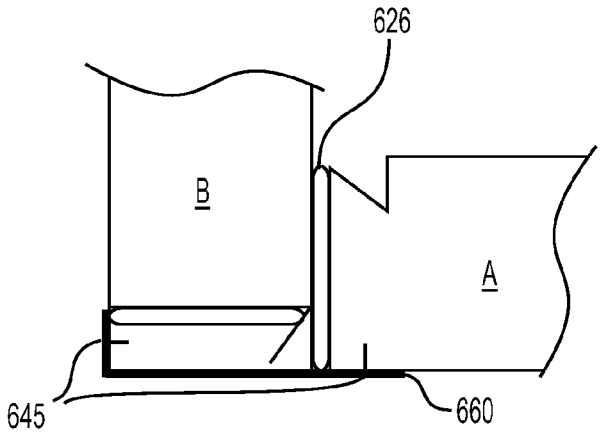
FIG. 6 depicts an embodiment of coupling perpendicular side panels.

FIG. 6 depicts the self-locking corner 660 used to couple perpendicular sections of wall. Self-locking corner 660 is preferably used to couple a track 210B of a first panel 105 to a track 210A of a second, perpendicular panel 105. Self-locking corner 660 is preferably coupled to tracks 210A and 210B with a fastener 645 (for example, a turn polycarbonate fastener, a rivet, a bolt, a screw, a brad, glue, adhesive, double-stick tape, or another fastener). A foam seal 626 or other insulation can be used between tracks 210A and 210B to improve the insulation of the structure.

Figure 7:
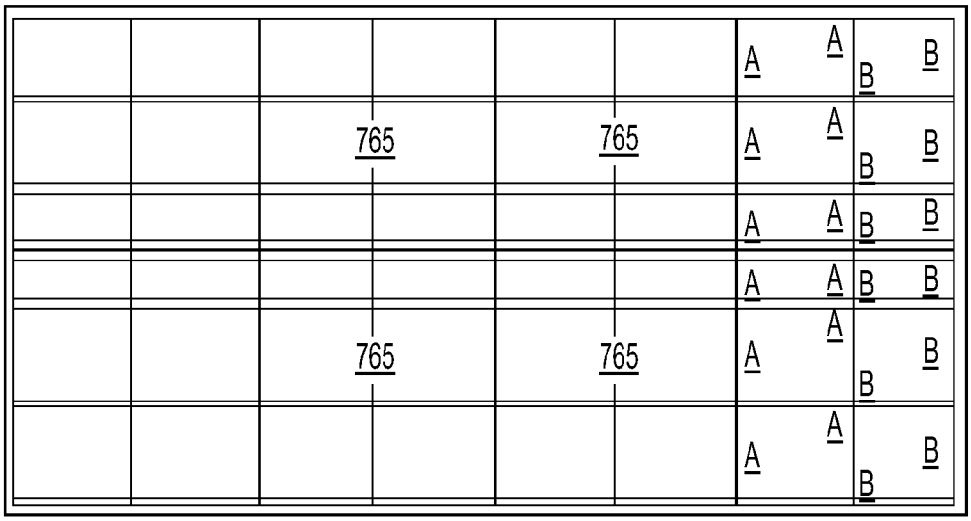
FIG. 7 depicts an embodiment of roof and floor panels.

FIG. 7 depicts roof and floor panels 765. Preferably roof and floor panels 765 are made of the same materials as panels 105. As shown in FIG. 7, roof and floor panels 765 are preferably 8 feet by 10 feet, however other dimensions can be used. In the preferred embodiment, each roof and floor panel 765 is coupled on two sides with track 210A and on two sides with track 210B, however other configurations can be utilized. Preferably, the roof is supported by beams. The beams preferably span the 20 foot section of the structure and are placed at 4 foot or 8 foot intervals, however other distributions and sizes of the beams can be used.

Figure 8:
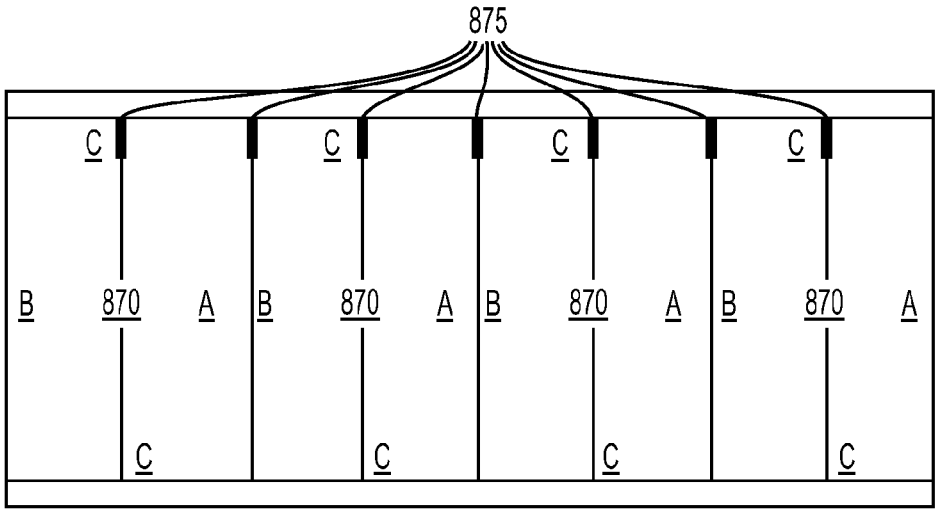
FIG. 8 depicts an embodiment of an exterior wall.

FIG. 8 depicts exterior wall sections 870 with cross beam roof supports at intervals. Exterior wall sections 870 are the same as panels 105, except exterior wall section 870 are able to be coupled to roof beams 875. In the preferred embodiment, wall sections 870 are installed down both sides of the temporary structure. Numerous configurations can be implemented to divide the structure into rooms by using panels such as section 870. Additional temporary structures can be coupled to the first temporary structure to create longer, wider, or stacked (e.g. two story) structures. The additional temporary structures can be coupled to the first temporary structure either side by side, end to end, or one on top of another.

Figure 9A:
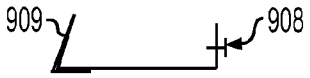
FIGS. 9A-B depict an embodiment of coupling a wall panel to a floor panel.
Figure 9B:
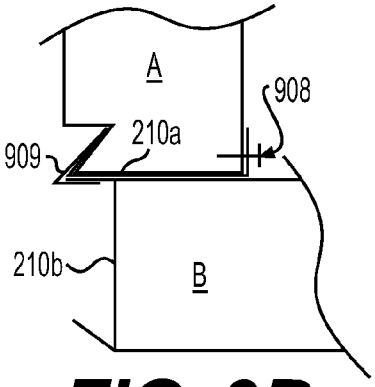

FIGS. 9A-B depict an embodiment of a coupling device 909 for coupling a wall panel coupled to track 210A to a floor panel coupled to track 210B. Coupling device 909 is substantially "C" shaped. As can be seen in FIG. 9B, the upper portion of coupling device 909 mates with track 210A and there is a flange that couples to straight hemmed tab 225 of track 210B. Coupling device 909 is preferably made of 20 or 24 gage steel, however other materials can be used. In the preferred embodiment a fastener 908 engages coupling device 909 and track 210A securely coupling the wall panel to the floor panel. Fastener 908 can be a turn polycarbonate fastener, a rivet, a bolt, a screw, a brad, glue, adhesive, double-stick tape, or another fastener.

Figure 10A:
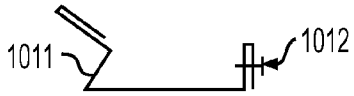
FIGS. 10A-B depict an embodiment of coupling a wall panel to a roof panel.
Figure 10B:
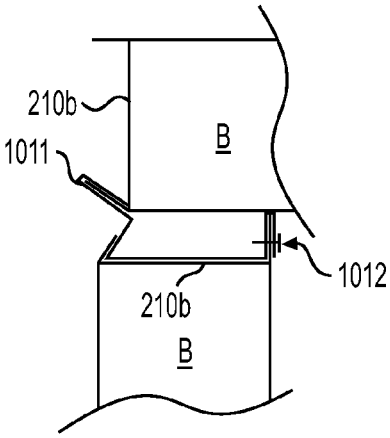

FIGS. 10A-B depict an embodiment of a coupling device 1011 for coupling a wall panel coupled to track 210B to a roof panel coupled to track 210B. Coupling device 1011 is substantially "C" shaped. As can be seen in FIG. 10B, the upper portion of coupling device 1011 has a flange that mates with the angled hemmed tab of the track 210B of the roof panel while the lower portion of coupling device 1011 mates with track 210B of the wall panel. Coupling device 1011 is preferably made of 20 or 24 gage steel, however other materials can be used. In the preferred embodiment a fastener 1012 engages coupling device 1011 and track 210B of the wall panel securely coupling the wall panel to the roof panel. Fastener 1012 can be a turn polycarbonate fastener, a rivet, a bolt, a screw, a brad, glue, adhesive, double-stick tape, or another fastener.

Figure 11A:
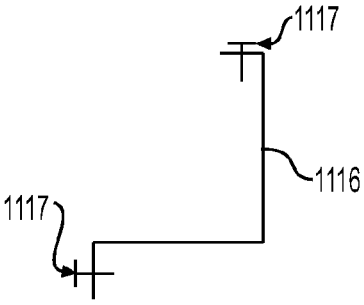
FIGS. 11A-B depict an embodiment of coupling a wall panel to a roof panel.
Figure 11B:
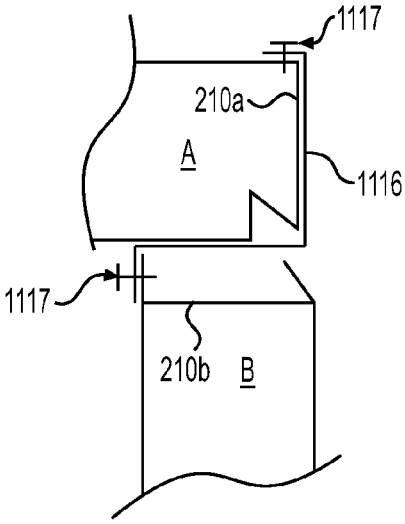

FIGS. 11A-B depict an embodiment of a coupling device 1116 for coupling a wall panel coupled to track 210B to a roof panel coupled to track 210A. Coupling device 1116 is substantially "C" shaped. As can be seen in FIG. 11B, the upper portion of coupling device 1116 surrounds track 210A of the roof panel, while the lower portion of coupling device 1116 abuts with track 210B of the wall panel. Coupling device 1116 is preferably made of 20 or 24 gage steel, however other materials can be used. In the preferred embodiment fasteners 1117 engage coupling device 1116 and both track 210B of the wall panel and track 210A of the roof panel, securely coupling the wall panel to the roof panel. Fasteners 1117 can be a turn polycarbonate fastener, a rivet, a bolt, a screw, a brad, glue, adhesive, double-stick tape, or another fastener.

Figure 12A:
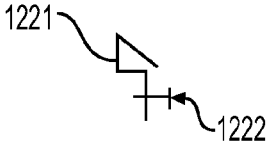
FIGS. 12A-B depict an embodiment of coupling two roof panels and a roof beam.
Figure 12B:
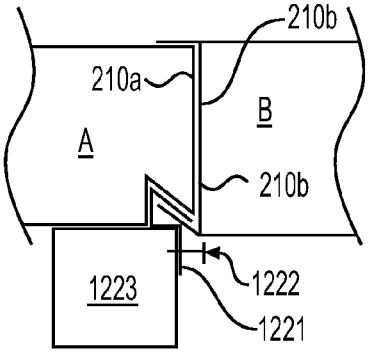

FIGS. 12A-B depict an embodiment of a coupling device 1221 for coupling two roof panels to a beam 1223. Coupling device 1221 is substantially "A" shaped. As can be seen in FIG. 12B, the upper portion of coupling device 1221 fits within the indented portion 215 of track 210A and over angled hemmed tab 220 of track 210B, while the lower portion abuts beam 1223. Coupling device 1221 is preferably made of 20 or 24 gage steel, however other materials can be used. In the preferred embodiment a fastener 1222 engages coupling device 1221 and beam 1223, securely coupling the roof panels to the beam 1223. Fastener 1222 can be a turn polycarbonate fastener, a rivet, a bolt, a screw, a brad, glue, adhesive, double-stick tape, or another fastener.

Figure 13A:
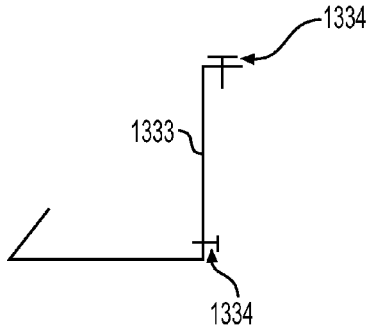
FIGS. 13A-B depict an embodiment of coupling a wall panel to a floor panel.
Figure 13B:
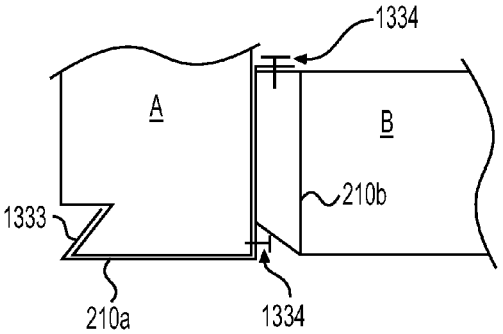

FIGS. 13A-B depict an embodiment of a coupling device 1333 for coupling two perpendicular wall panels at a corner. Coupling device 1333 is substantially "C" shaped. As can be seen in FIG. 13B, the left portion of coupling device 1333 mates with track 210A of a first wall panel, while the right portion of coupling device 1333 abuts track 210B of the second wall panel. Coupling device 1333 is preferably made of 20 or 24 gage steel, however other materials can be used. In the preferred embodiment fasteners 1334 engage coupling device 1333 and both track 210A of the first wall panel and track 210B of the second wall panel, securely coupling the wall panels. Fasteners 1334 can be a turn polycarbonate fastener, a rivet, a bolt, a screw, a brad, glue, adhesive, double-stick tape, or another fastener.

Figure 14A:
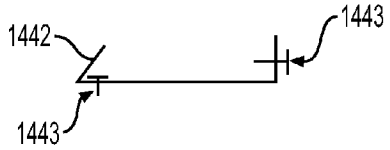
FIGS. 14A-B depict an embodiment of coupling a wall panel to a floor panel.
Figure 14B:
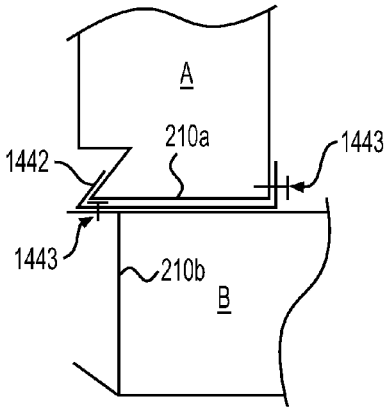

FIGS. 14A-B depict an embodiment of a coupling device 1442 for coupling two perpendicular wall panels at a corner. Coupling device 1442 is substantially "C" shaped. As can be seen in FIG. 14B, the upper portion of coupling device 1442 mates with track 210A of a first wall panel, while the lower portion of coupling device 1442 abuts track 210B of the second wall panel. Coupling device 1442 is preferably made of 20 or 24 gage steel, however other materials can be used. In the preferred embodiment fasteners 1443 engage coupling device 1442 and both track 210A of the first wall panel and track 210B of the second wall panel, securely coupling the wall panels. Fasteners 1442 can be a turn polycarbonate fastener, a rivet, a bolt, a screw, a brad, glue, adhesive, double-stick tape, or another fastener.

In the preferred embodiment, each of the components of the temporary structure is manufactured off-site, and then the components are delivered to the site of the temporary structure where they are assembled. Preferably, the temporary structure can be assembled and disassembled with minimum effort and tools. Furthermore, the components can be reused so that the structure is re-locatable. Preferably, during assembly, each fastener is installed either from the inside of the structure or from the roof of the structure.

Figure 15A:
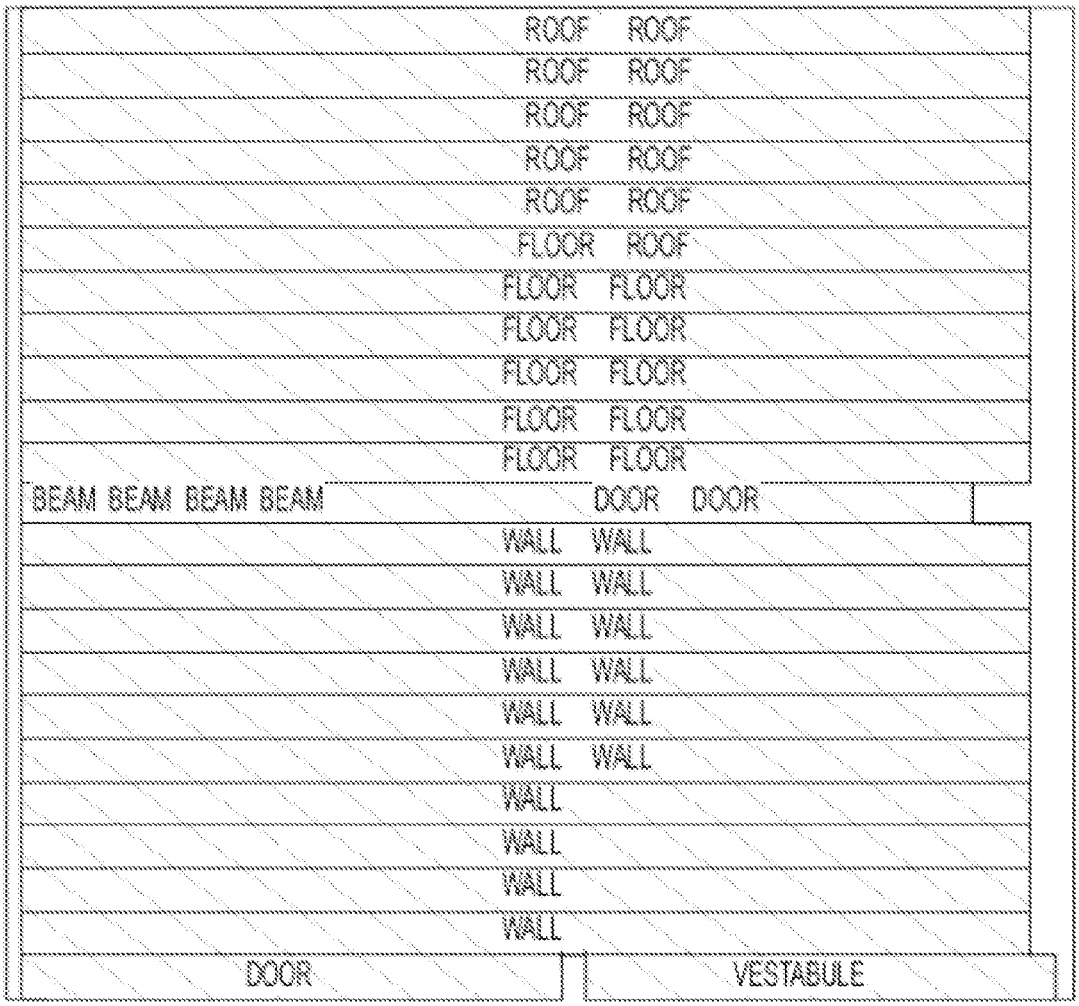
FIGS. 15A-B depict an embodiment of the elements of an exemplary structure contained within a standard shipping container.
Figure 15B:
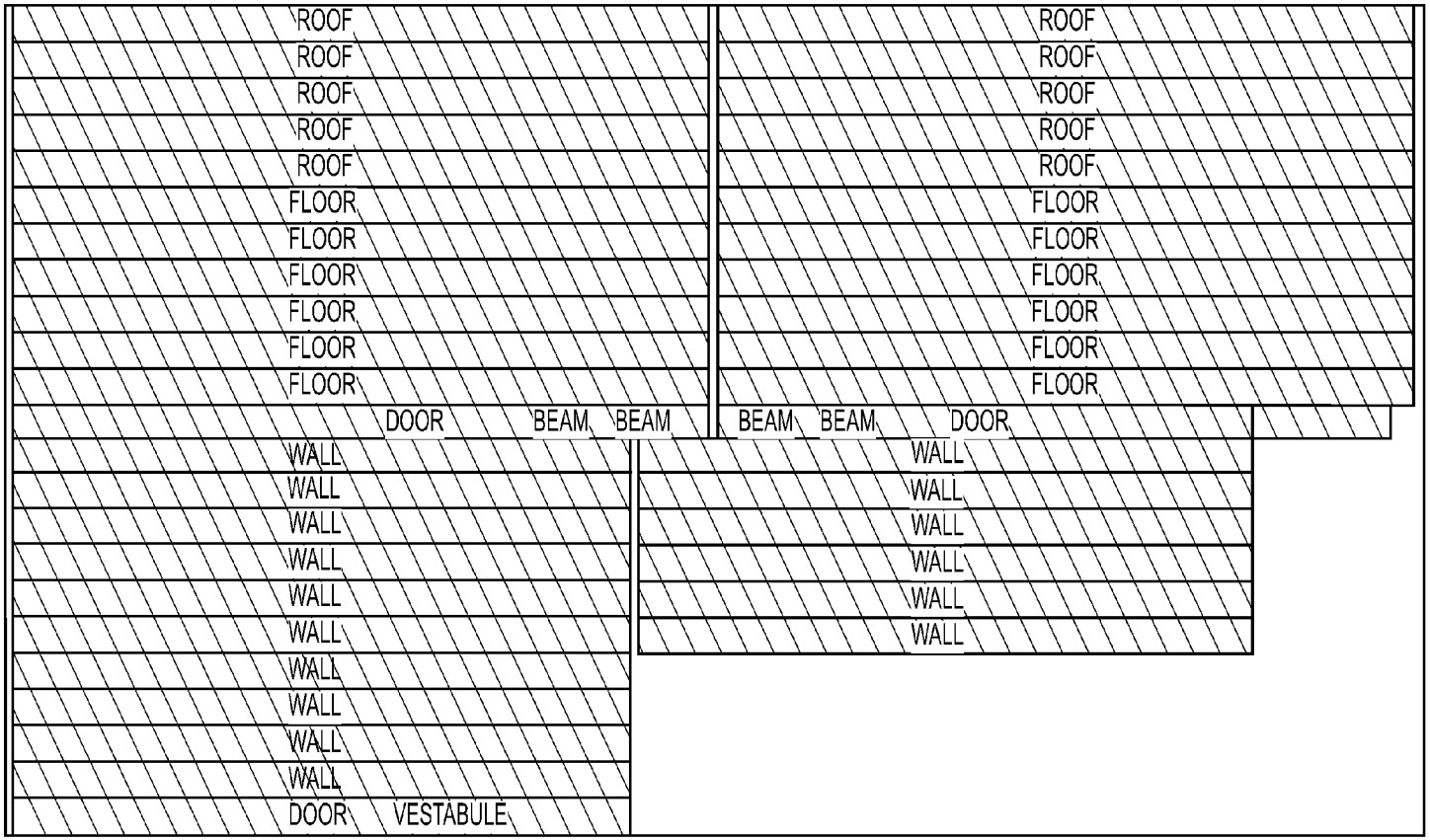

FIGS. 15A-B depict all of the components for an approximately 20'×40' temporary structure fit within a standard 20 foot shipping container for transportation. The arrangement of the components as shown in FIGS. 15A-B is merely one possible configuration. Different configurations can be implemented for different projects and different selections of components. In locations where wind is an issue, traditional anchors and tie downs can be used to secure the temporary structure. In the preferred embodiment, the roof can support at least a 40 lb load, however in other embodiments the roof can support greater loads.

Figure 16:
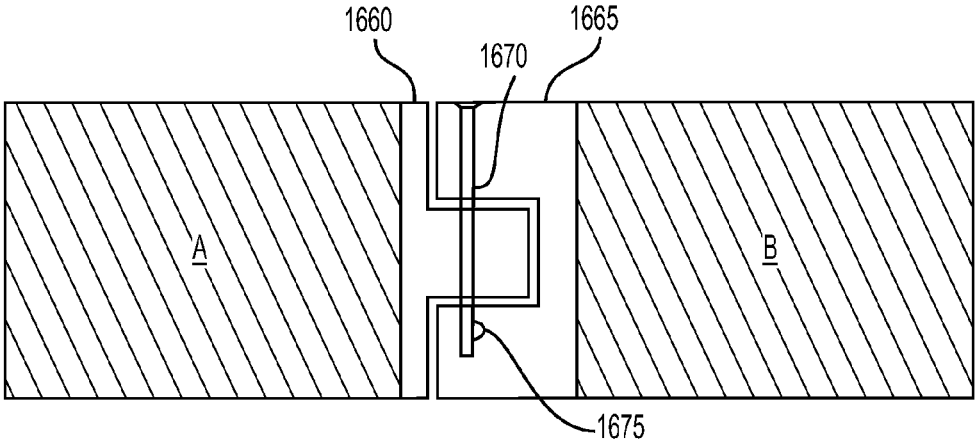
FIG. 16 depicts another embodiment of a panel coupling.

FIG. 16 depicts another embodiment of a coupling between two adjacent wall panels. The coupling depicted in FIG. 16 is a tongue and groove system. As shown, panel A is coupled to a tongue connector 1660, while panel B is coupled to a groove connector 1665. While one tongue connector 1660 and one groove connector 1665 is shown, another number of tongues and grooves can be implemented. In the preferred embodiment, tongue connector 1660 and groove connector 1665 are both made of the same material. For example, both connectors can be metal, plastic, wood, fiberglass, concrete, or another naturally occurring or manmade material. Each panel preferably has two edges that have tongue connectors and two edges that have groove connectors, however other configurations are possible.

In the preferred embodiment, both tongue connector 1660 and groove connector 1665 are hollow, thereby providing an open space between the connectors and the ends of panel A and B. In a preferred embodiment, an insulating material is placed between tongue connector 1660 and groove connector 1665 during assembly. The insulating material can be foam, fabric, fiberglass, or another insulating material. In a preferred embodiment, one or more of panel A and panel B may have an alignment pin to facilitate coupling tongue connector 1660 and groove connector 1665 during assembly.

Preferably, a locking pin 1670 is placed through both tongue connector 1660 and groove connector 1665, as shown in FIG. 16. Locking pin 1670 preferably is inserted into a predrilled hole in both connectors after they are coupled together. Locking pin 1670 is preferably countersunk so the head of locking pin 1670 does not extend beyond the surface of either panel A or B. Locking pin 1670 may have a cam 1675 that extends from the body of locking pin 1670. Preferably cam 1675 is biased away from the center of locking pin 1670 with a spring. Cam 1675 preferably prevents locking pin 1670 from accidently coming out. However, cam 1675 allows locking pin 1670 to come out to disassemble panels A and B. Locking pin 1670 is preferably a metal rod about the size of a standard nail.

Figure 17:
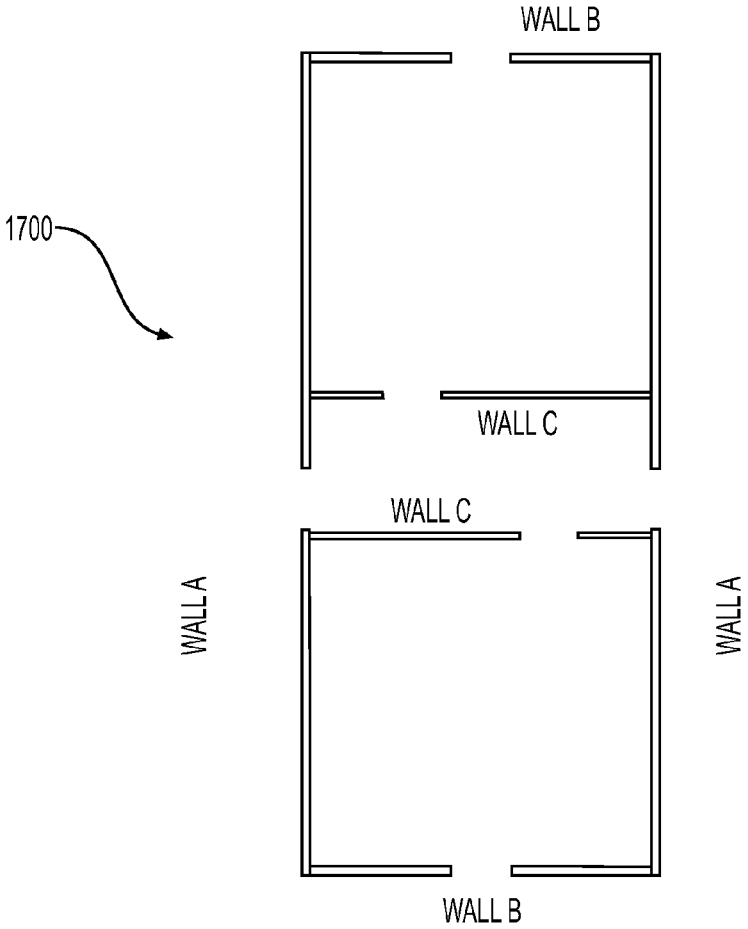

FIGS. 17-30 display different views of an embodiment of a one story relocatable structure 1700. FIG. 17 displays a general floor plan of an embodiment of the one story relocatable structure 1700. In structure 1700 the floor plan is divided into two rooms with a central vestibule. While two rooms are shown, another number of rooms can be set up (e.g. one room, three rooms, or four rooms). Additionally, structure 1700 may not have a vestibule or may have multiple vestibules. Structure 1700 is comprised of two long outer walls A, two short outer walls B, and two interior walls C. While structure 1700 is depicted as a rectangular structure, structure 1700 can have another shape, including but not limited to square, round, or triangular.

FIGS. 18A-B depict an embodiment of long outer wall A. In the preferred embodiment, wall A is comprised of a plurality of wall panels, as described herein, and an entrance way. Depending on the length of wall A, a different number of wall panels can be installed. Wall A can also have more than one entrance way or no entrances. Additionally, the entrance way can have a different placement. Preferably, the entrance ways are identical to the wall panels with a hole cut out for a door or other method of entering and exiting structure 1700.

FIGS. 19A-B depict an embodiment of a short outer wall B while FIGS. 20A-B depict an embodiment of an interior wall C. In the preferred embodiment wall B is similar to wall C. For example, walls B and C have the same dimensions and both use the same panels. However, in the embodiment shown, the entrance ways of walls B and C are located at different positions. In other embodiments, walls B and/or C can have more than one entrance ways or no entrances. Depending on the length of walls B and C, a different number of wall panels can be installed.

Figure 21:
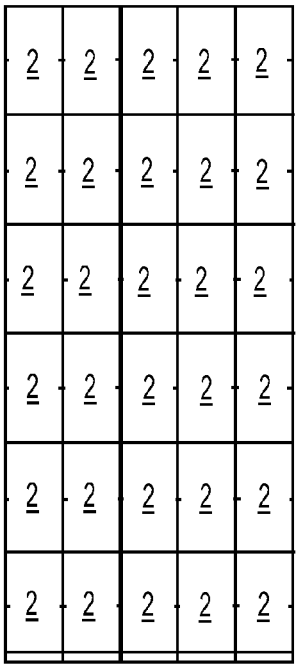
Figure 22:
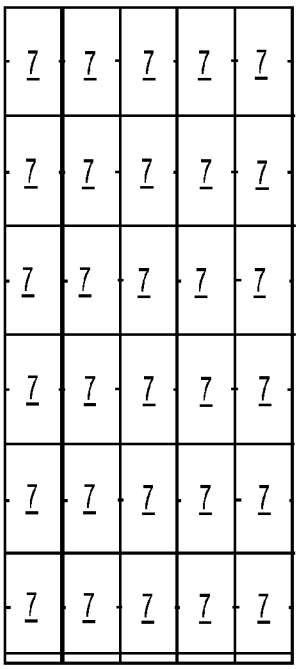

FIGS. 21 and 22 depict embodiments of floor and roof layouts for structure 1700. In the preferred embodiment, both the floor and roof layouts are identical. Each uses panels as described herein. The number of panels used and the orientation of the panels may differ depending on the dimensions of structure 1700. In a preferred embodiment, each panel may have pre-drilled holes to facilitate installation of the panels.

Figure 23:
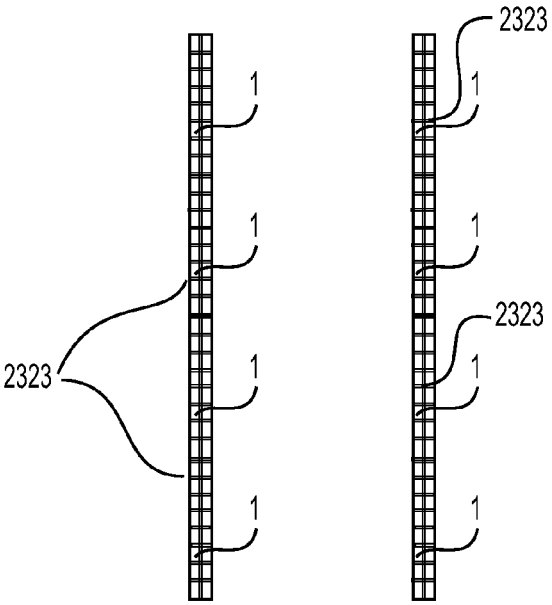

FIG. 23 depicts an embodiment of foundation panels 2323 to support structure 1700. Foundation panels 2323 are preferably steel however, other high straight low weight materials can be used. In the preferred embodiment, foundation panels 2323 run along two parallel sides of structure 1700. However in other embodiments foundation panels 2323 can be installed under more than two sides and/or in central positions. In the preferred embodiment, foundation panels 2323 sit on top of the underlying ground and are not buried. However, in other embodiments foundation 2323 panels can be at least partially buried.

Figure 24:
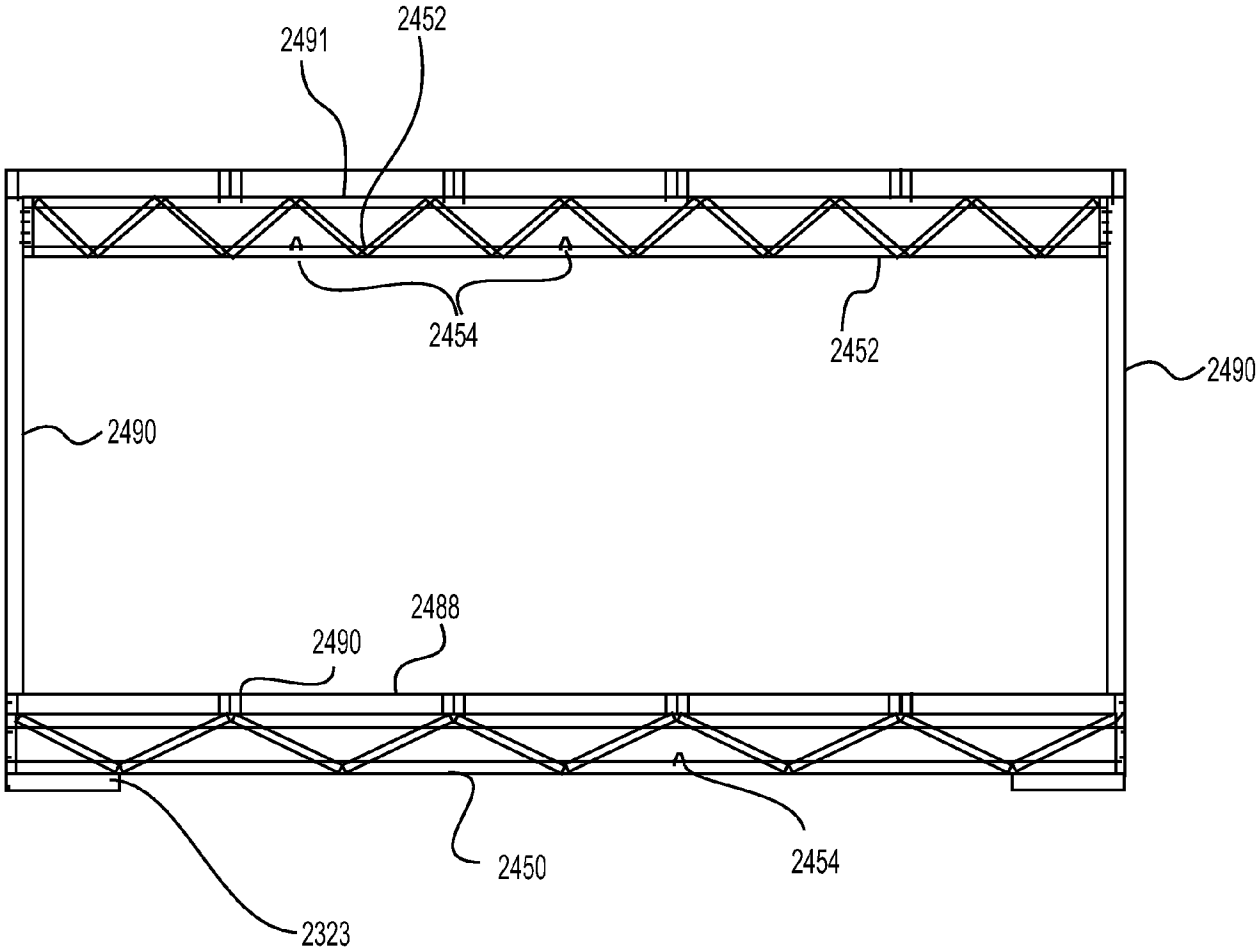
Figure 29:
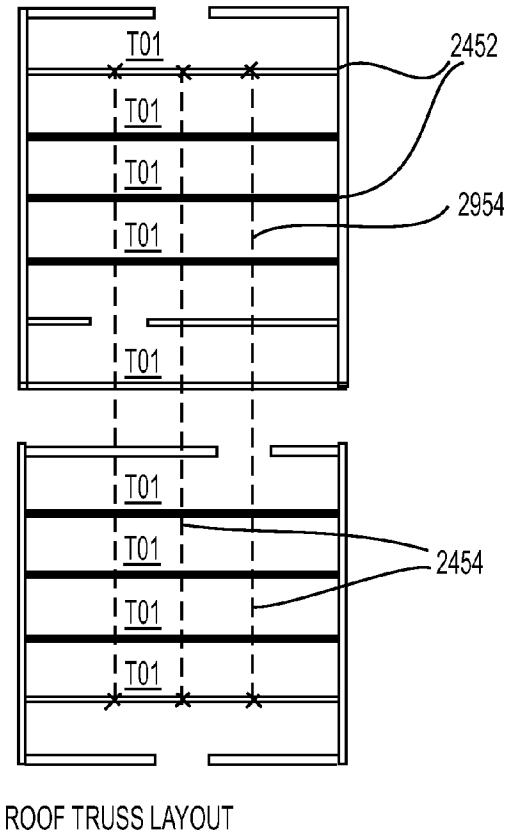
Figure 28:
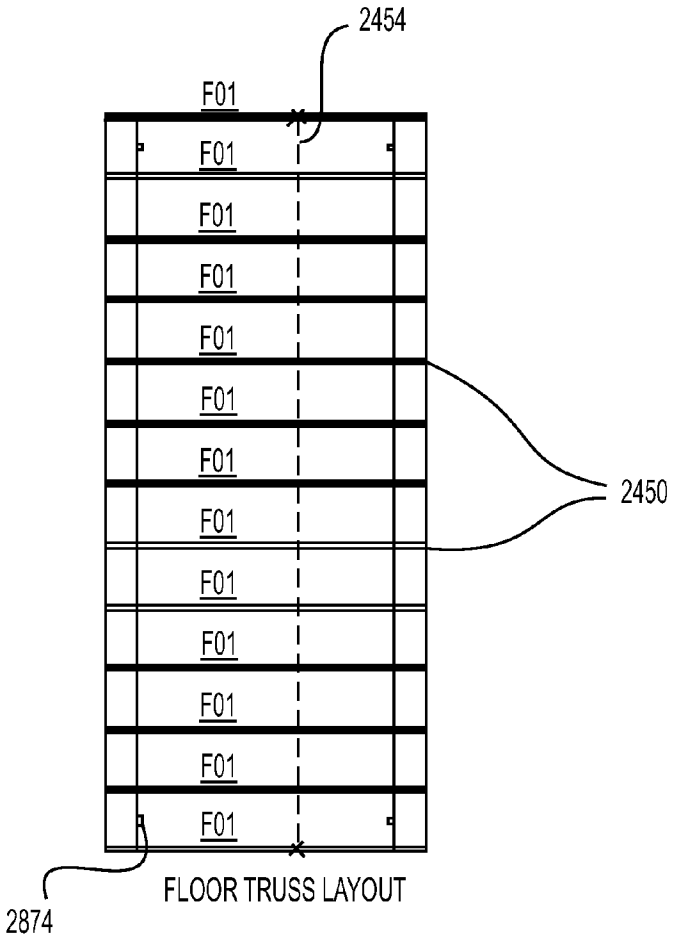

FIG. 24 depicts an embodiment of the structural trusses supporting structure 1700. Preferably, there is at least one sub-floor truss 2450 and at least one sub-roof truss 2452. Sub-floor truss 2450 is placed atop foundation panels 2323 and the floor panels 2488 are placed atop sub-floor truss 2450. In the preferred embodiment, the floor panels 2488 are secured to sub-floor truss 2450 by screws, however other fastening devices and method can be used. Metal Floor trusses 2489 may be placed between floor panels 2488. Sub-roof truss 2452 is secured between wall panels 2490 and the roof panels 2491 are placed atop sub-floor truss 2452. In the preferred embodiment, the roof panels 2491 and wall panels 2491 are secured to sub-roof truss 2450 by screws, however other fastening devices and method can be used. Additionally, in embodiments where there are multiple sub-floor trusses 2450 and/or sub-roof trusses 2452 are installed, the trusses may be aligned and prevented from twisting with hat channels 2454. Hat channels 2454 are preferably beams that are coupled to perpendicularly to each of the sub-roof trusses. One or more hat channels 2454 can be installed. In the preferred embodiment, hat channels 2454 coupled to the floor trusses 2450 preferably extend the entire length of the structure 1700 (as shown in FIG. 28), while the hat channels 2454 coupled to the roof trusses 2452 extend from the first roof truss to the last roof truss (as shown in FIG. 29).

Figure 25A:
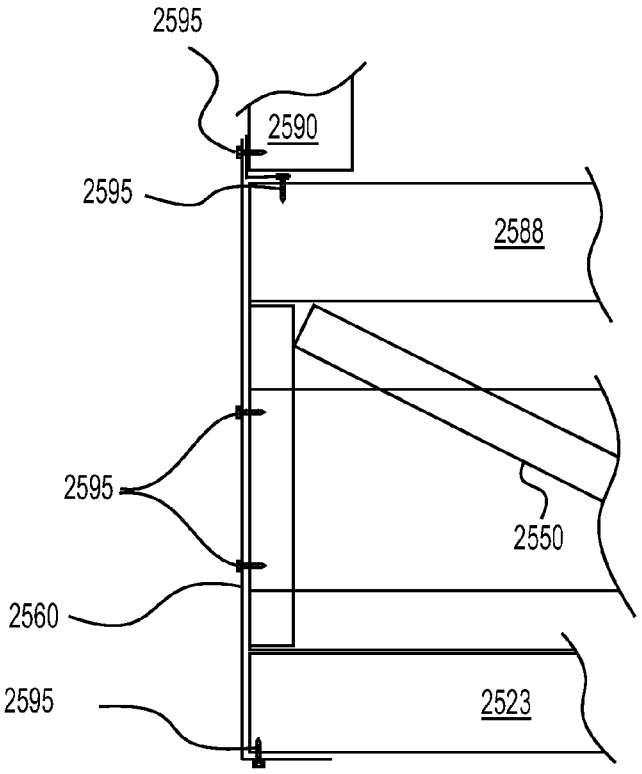
Figure 25B:
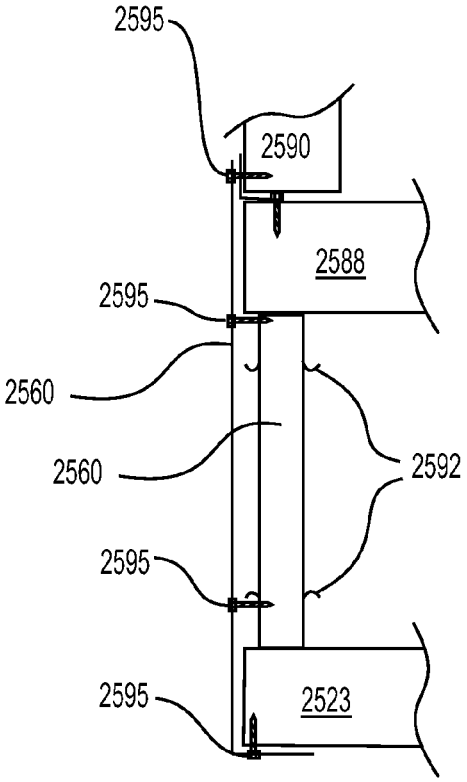

FIGS. 25*a* and 25*b* depict two views of an embodiment of a floor coupling device 2560. Preferably floor coupling device 2560 is a metal bracket (although other materials can be used) used to couple wall panels 2590, floor panels 2588, floor trusses 2550 and foundation panels 2523 to improve the stability of structure 1700. Preferably each element is coupled to floor coupling device 2560 with screws 2595 or other fastening devices or methods. Additionally, a second bracket can be installed to couple wall panels to floor panels. Floor coupling device 2560 can be placed at regular intervals along structure 1700, randomly, or can run the length of each wall. Preferably each wall has at least one floor coupling device 2560. Furthermore, as can be seen in FIG. 25*b*, portions 2590 of the floor trusses 2550 can be bent or curved to increase the strength of the materials.

Figure 26:
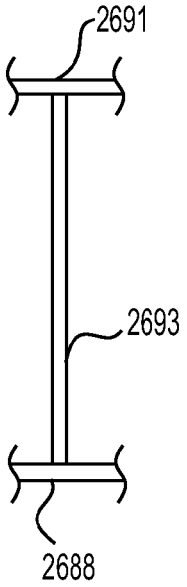

FIG. 26 depicts a view of an embodiment of the coupling of an interior wall C to roof and floor panels. In the preferred embodiment, an "L" shaped bracket is coupled (e.g. with screws, bolts, rivets, nails, adhesive, or another fastening device or method) to the floor panel and another "L" shaped bracket is coupled to the roof panel. The wall panel is then coupled to the two "L" shaped brackets, thereby installing the interior wall panel into structure 1700.

Figure 27A:
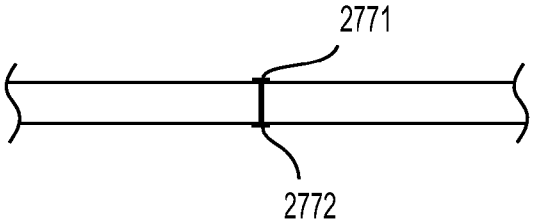
Figure 27B:
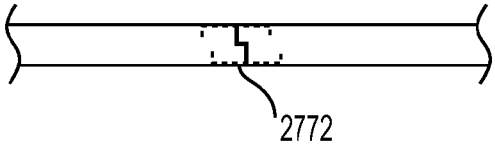

FIGS. 27A-B depict embodiments of devices to couple floor or roof panels together. The butt panel joint depicted in FIG. 27A is preferably comprised of two "T" shaped trim pieces. One trim piece preferably has a female end 2771 and one trim piece preferably has a male end 2772. The trim piece with the female end 2771 is preferably inserted between two adjoining panels. Then, the trim piece with the male end 2772 is inserted between the two adjoining panels and into the female end 2771, thereby joining the two trim pieces and securing the adjoining panels together. FIG. 27B, on the other hand, depicts a shiplap panel joint. The shiplap panel joint is similar to the butt panel joint except that the two adjoining wall panels have matching rabbets or grooves cut into the ends of the panels to aid in construction and provide extra support to the joints. The trim pieces are preferably made of metal, however other materials can be used.

Figure 30:
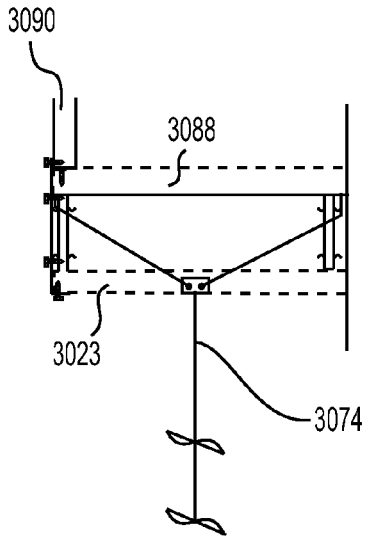

FIG. 30 depicts an embodiment of a structure tie-down 3074. In the preferred embodiment, at least one tie-down is used to secure structure 1700 to the ground. Preferably, the tie-downs are coupled to the foundation panels 3023, which are coupled to the sub-floor trusses 3050. The tie-down preferably are able to penetrate the ground by being screwed into the ground. However other methods of securing the tie-downs into the ground can be used, depending on the composition of the ground. Preferably, the tie-downs prevent structure 1700 from moving due to natural (e.g. earth quakes or floods) or unnatural occurrences (e.g. explosions or accidents).

Figure 31:
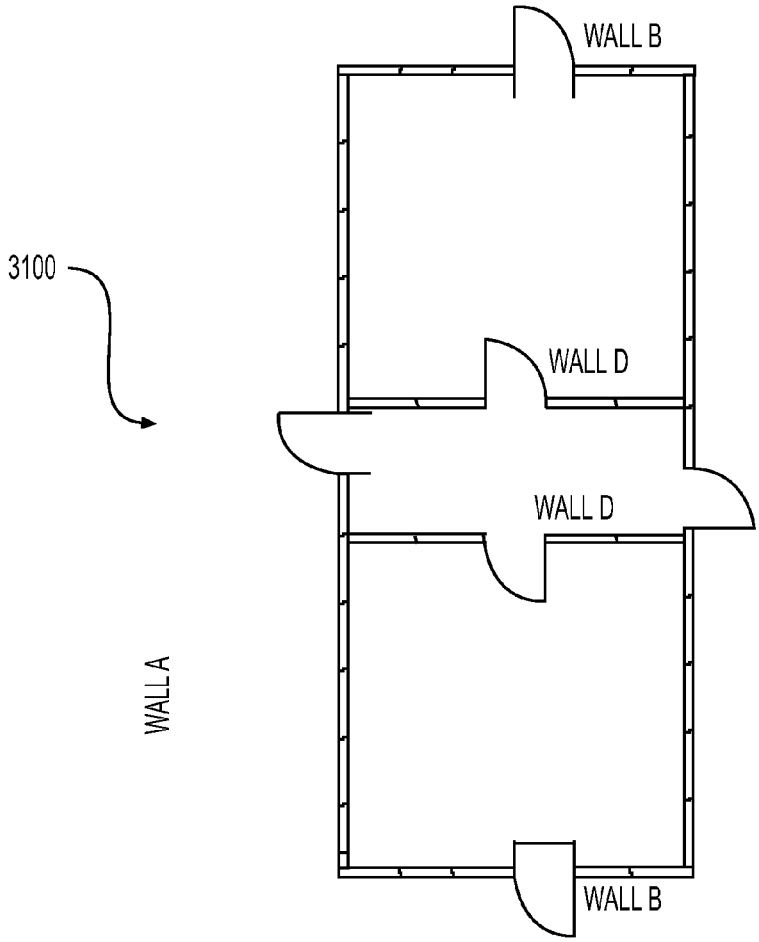
FIGS. 31-39 depict different views of another embodiment of a one storey relocatable structure.
Figure 32:
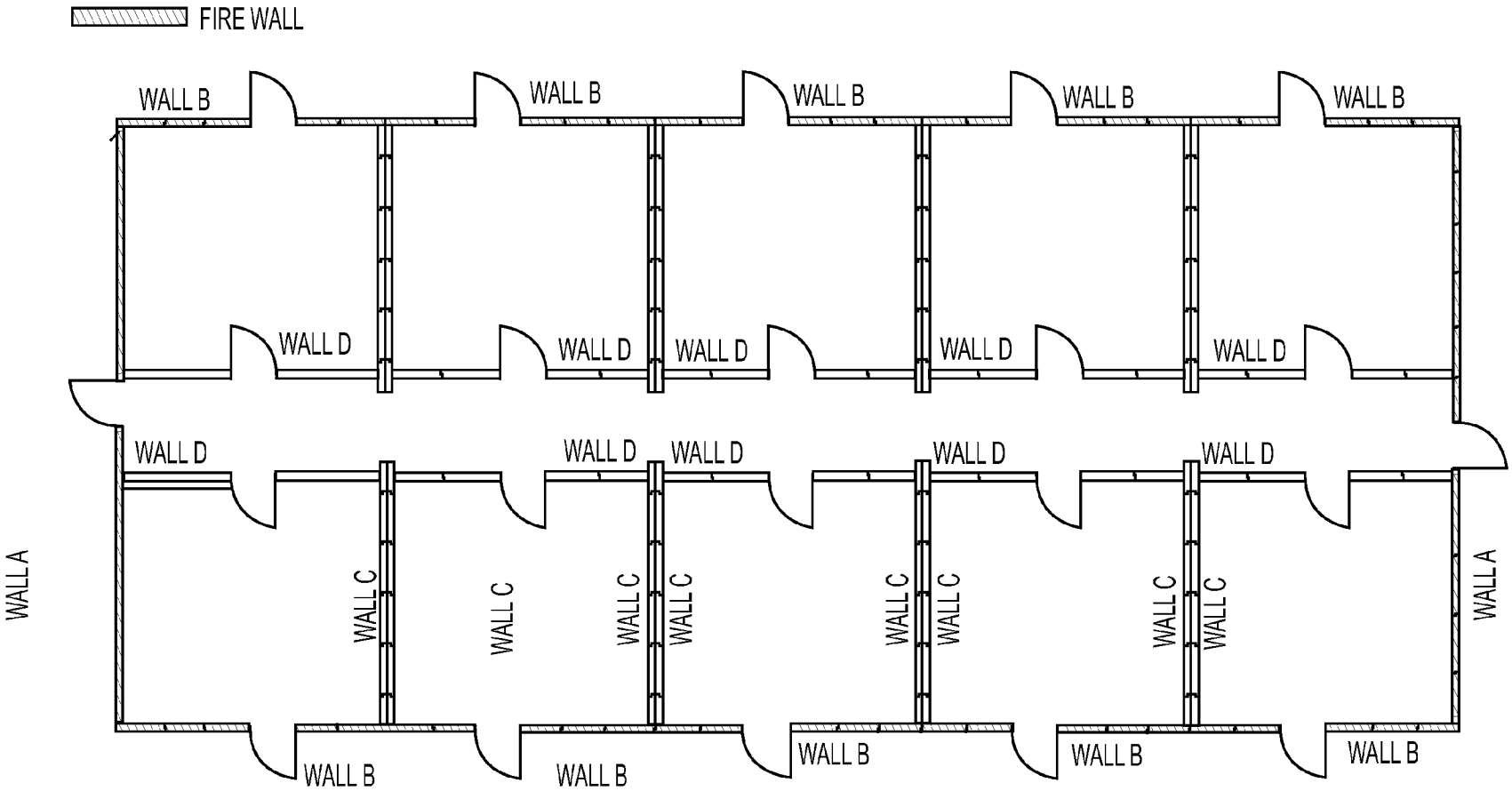

FIGS. 31-39 depict another embodiment of a relocatable structure 3100. FIG. 31 depicts a general floor plan of relocatable structure 3100. Relocatable structure 3100 is similar to structure 1700, with a different interior configuration. As can be seen in FIG. 17, structure 1700 has staggered interior door openings while, as can be seen in FIG. 31, structure 3100 has interior door openings that are across from each other. FIG. 32 depicts another floor plan similar to the floor plan depicted in FIG. 31, however the structure in FIG. 32 contains 10 rooms while the structure depicted in FIG. 31 has two rooms. The structure can be extended to more than 10 rooms or shortened to less than 10 rooms depending on the required use. Moreover, not all rooms need be of the same dimensions.

Figures 33A, 33B:
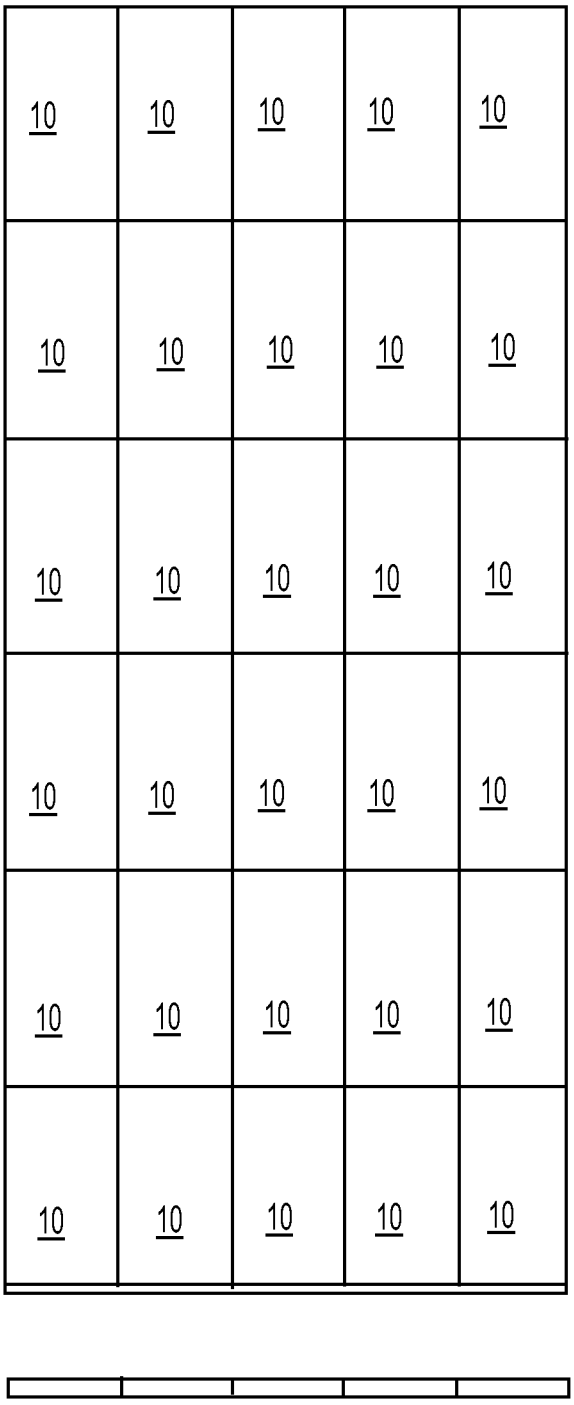

FIGS. 33A-B depict the general layout of the floor and roof panels 10. In the preferred embodiment, both the floor and roof layouts are identical. Each preferably uses panels as described herein. The number of panels used and the orientation of the panels may differ depending on the dimensions of structure 3100. In a preferred embodiment, each panel may have pre-drilled holes to facilitate installation of the panels.

Figure 35:
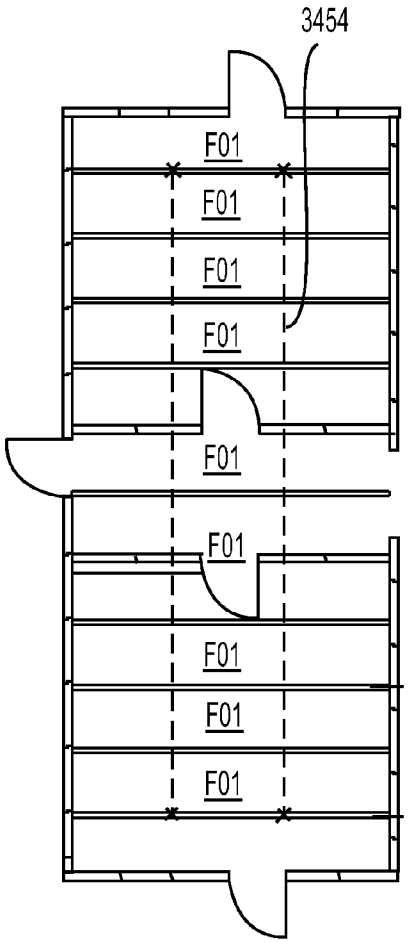
Figure 34:
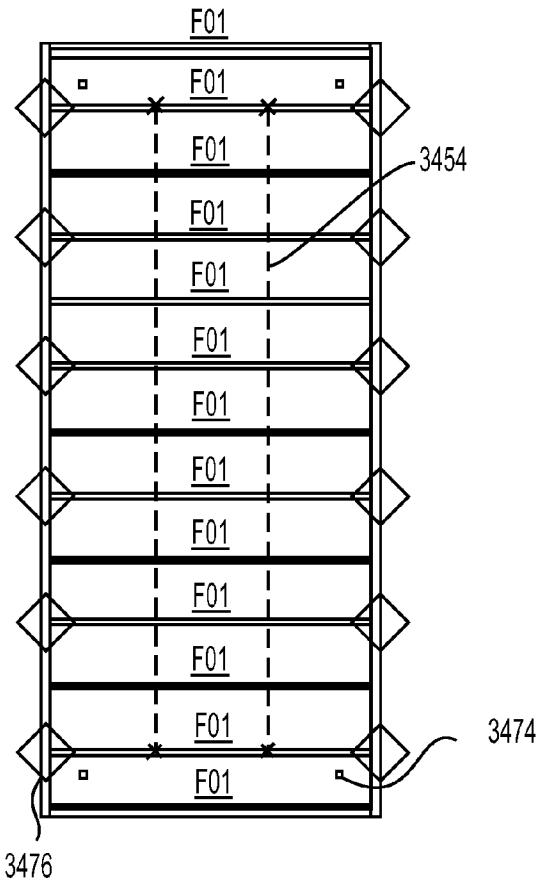
Figure 36:
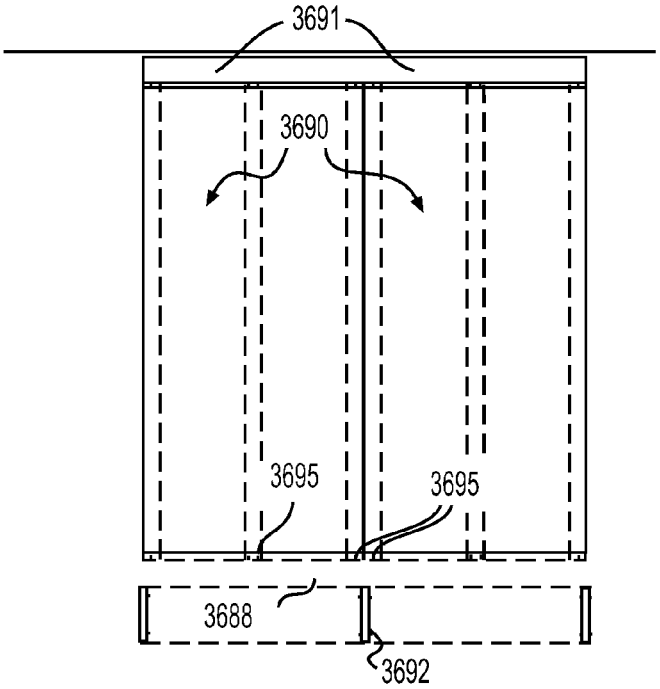
Figure 37:
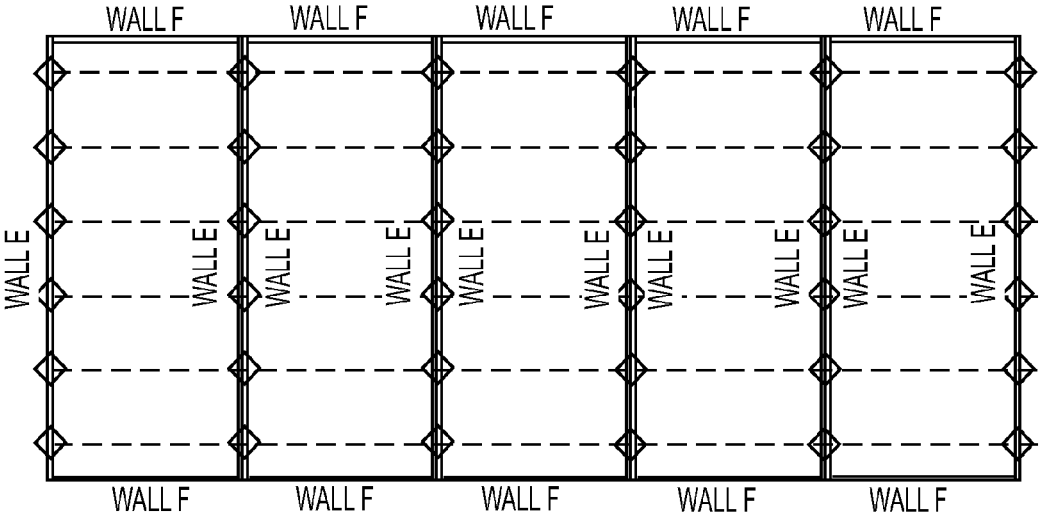

FIGS. 34 and 35 display the support trusses used to support the floor and roof panels, respectively. While the figures show trusses, other support structures can be utilized, including but not limited to beams, T-bars, I-beams, or rods. As can be seen in FIGS. 34 and 35, hat channels 3454 are attached to the structure to provide additional support. FIG. 36 depicts a section of wall, showing the joining of the wall panels 3690 to the floor 3688 and roof panels 3691. Preferably, the wall panels are coupled to the floor and roof panels with screws 3695. However, other fastening devices can be utilized. FIG. 37 depicts the support panel layout of the embodiment of the structure depicted in FIG. 32.

Figure 39:
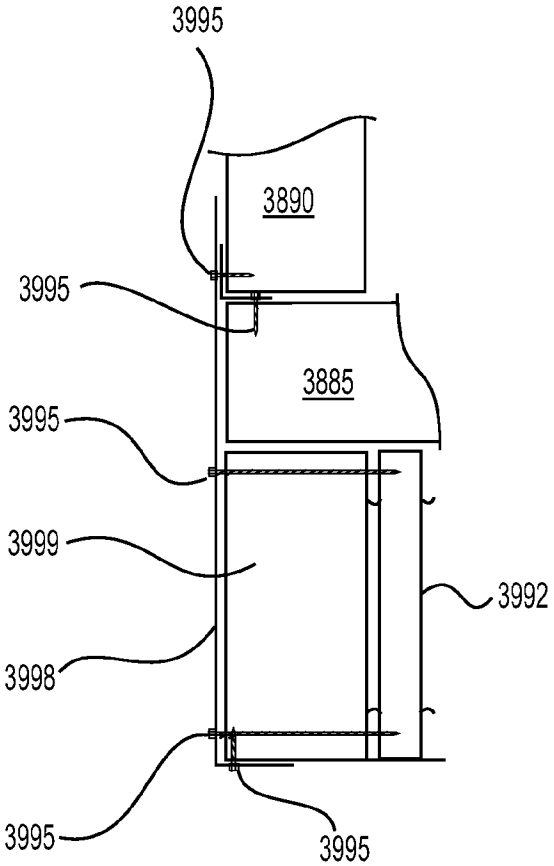
Figure 38:
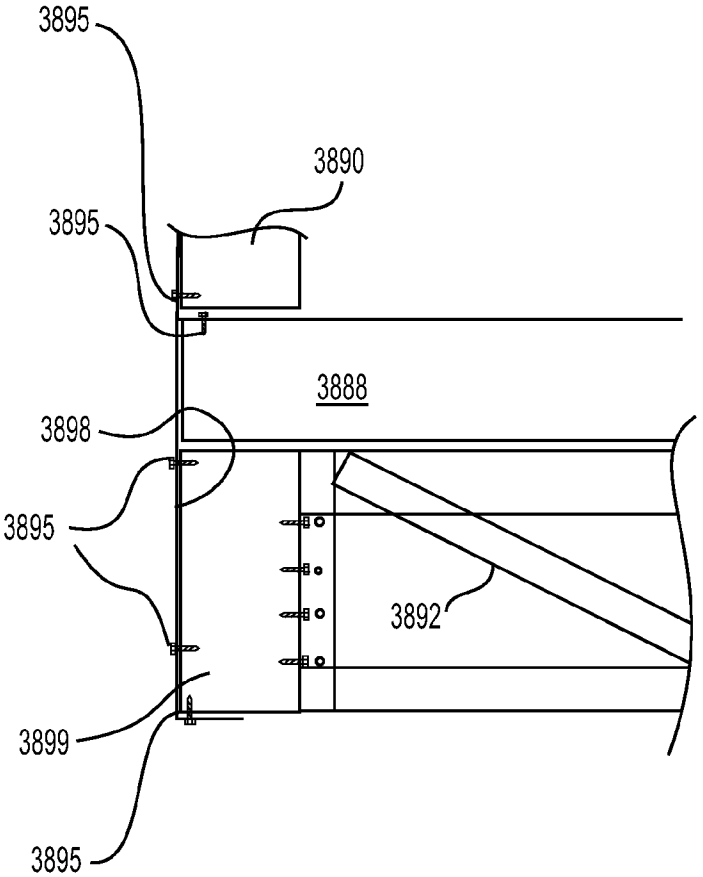

FIGS. 38 and 39 depict close-up views of two embodiments of the wall-floor-support truss connection. FIG. 38 depicts the connection to the end of the truss 3892, while FIG. 39 depicts the connection to the side of the truss 3992. In the embodiment shown in FIG. 38, preferably, a support panel 3899 is provided at the end of the floor truss 3892 and below the floor panel 3888. Likewise, in the embodiment shown in FIG. 39, a skirt panel 3999 is provided along the floor truss 3992 and below the floor panel 3885. Preferably, the floor panels are installed prior to the wall panels being installed. In both connections, preferably a coupling device 3898 and 3998 is used to secure the truss, floor panels, wall panels, support panels and/or skirt panels together. Preferably, the coupling device 3898 and 3998 is secured to the various panels with screws 3895 and 3995, however other fastening devices can be used.

Figure 40:
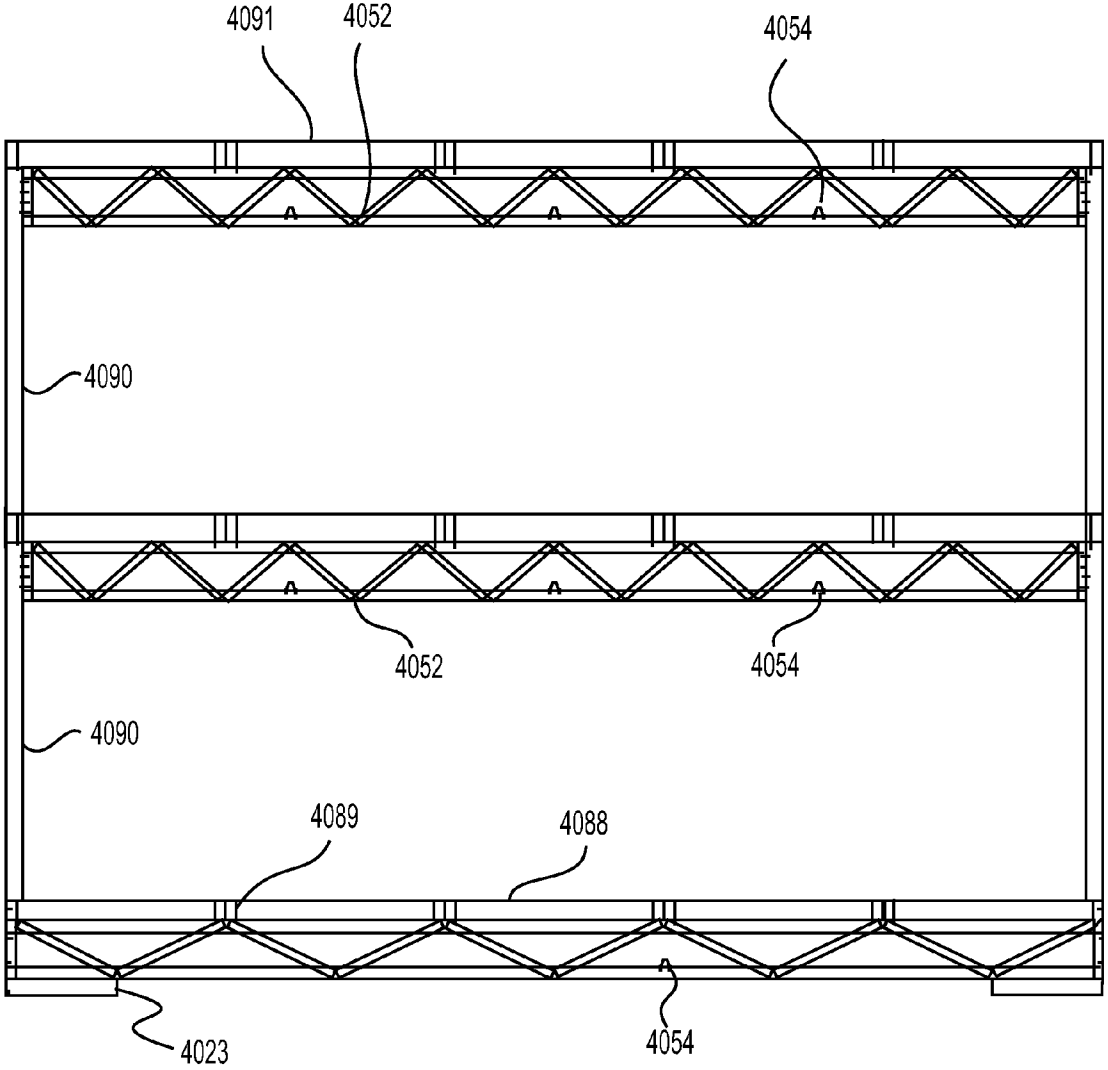
FIG. 40 depicts a view of an embodiment of a two story relocatable structure.

FIG. 40 depicts an embodiment of a two story relocatable structure 4000. Preferably structure 4000 is identical to the one story structures except that a second level is placed atop the first level. Since the roof panels and floor panels are preferably identical, the roof panels of structures 1700 and 3100 become the second story's floor panels of structure 4000. Another set of wall panels, roof panels, and sub-roof trusses is added to create the second story. More than two stories can be added (or ganged) to structure 4000 and additional levels can be added over portions of the structure while the remaining portions are a single story.

FIG. 41A-D depict another embodiment of a two story relocatable structure 4100. Structure 4100 is depicted as two stories high and multiple sub-structures long (for example structures 1700 or 3100 can be the sub-structures of structure 4100). Preferably, structure 4100 rests on an adjustable support bracket 4176 (for example as shown in FIGS. 42A-C). The adjustable support bracket 4176 is preferably able to adjust in height so that the supported structure is level even on unlevel ground. Preferably, there is one adjustable support bracket at every corner of the structure or sub-structures, however more or fewer adjustable support brackets can be installed.

FIGS. 49A-D depict another embodiment of an adjustable support bracket 4990. Bracket 4990 is preferably comprised of a base plate 4991, a threaded rod 4992 passing through a nut 4993 coupled to base plate 4991, a cap plate 4994, and a nut 4995 coupled to cap plate 4994. Preferably, threaded rod 4992 is screwed into nut 4995 and cap plate 4994 is removable affixed to the structure. By adjusting the position of nut 4993 on threaded rod 4992, the height of support bracket 4990 can be adjusted. Support bracket 4990 may additionally have braces 4996 to improve the stability of the support. Braces 4996 may be coupled, at an angle between base plate 4991 and the structure to help prevent overturn of the structure.

Figure 41A:
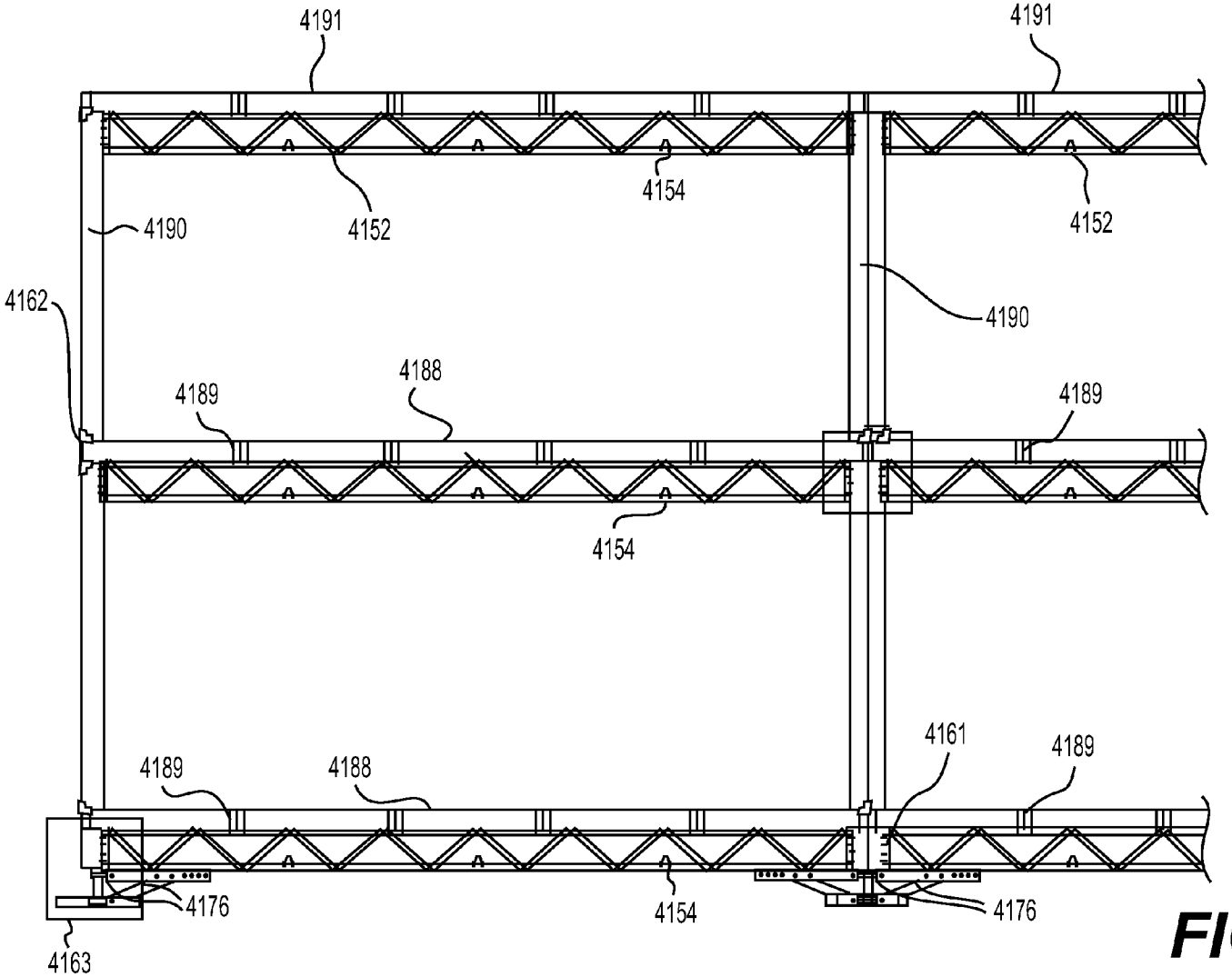
FIGS. 41A-D depict views of another embodiment of a two story relocatable structure.
Figure 41B:
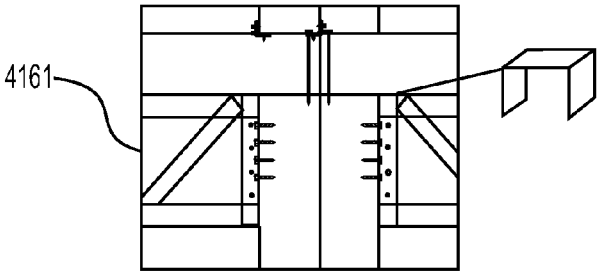
Figure 41C:
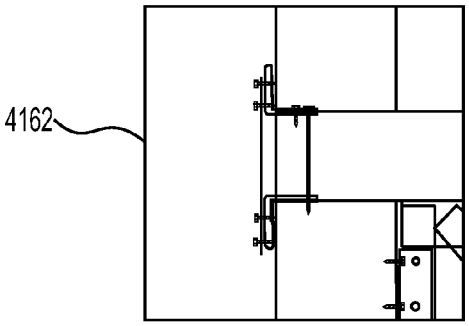
Figure 41D:
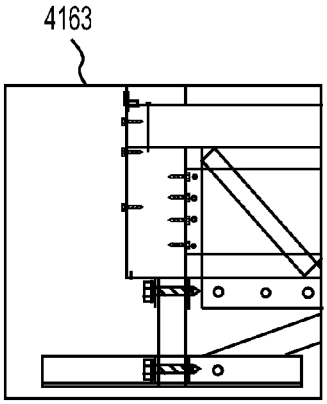
Figure 42A:
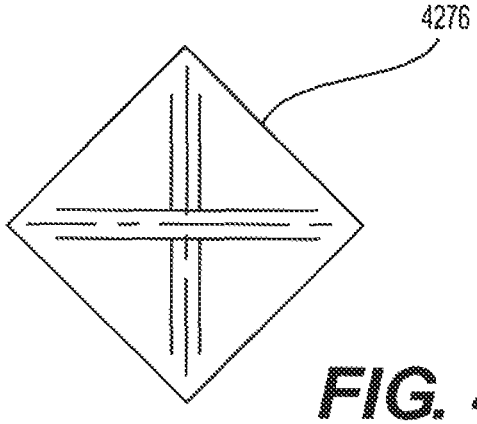
FIGS. 42A-C depict an embodiment of an adjustable structure support.
Figure 42C:
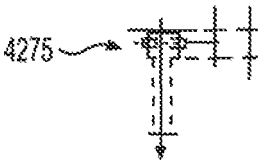
Figure 42B:
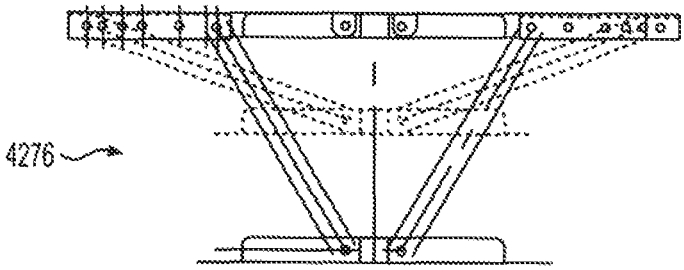

FIG. 41B depicts a coupling between two adjacent substructures using a building joint connector 4161. FIG. 41C depicts a level coupling bracket 4162 coupling two floors at the exterior walls. FIG. 41D depicts a coupling 4163 between the floor and an adjustable support bracket. Each of the couplings preferably use screws, however other fastening devices can be implemented.

Figure 45A:
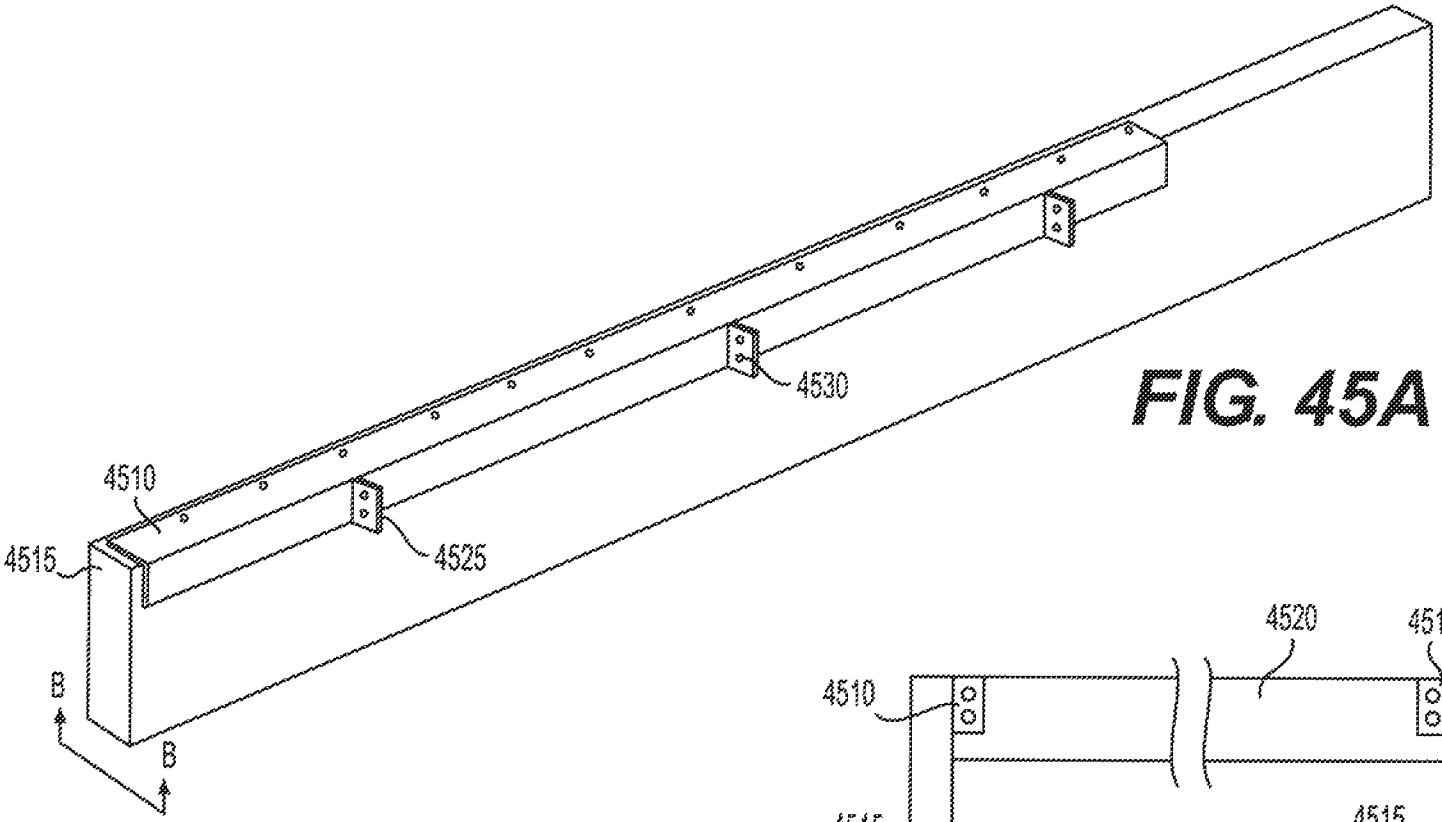
FIGS. 45A-B depict perspective and side views of a load-distributing member, respectively.
Figure 46A:
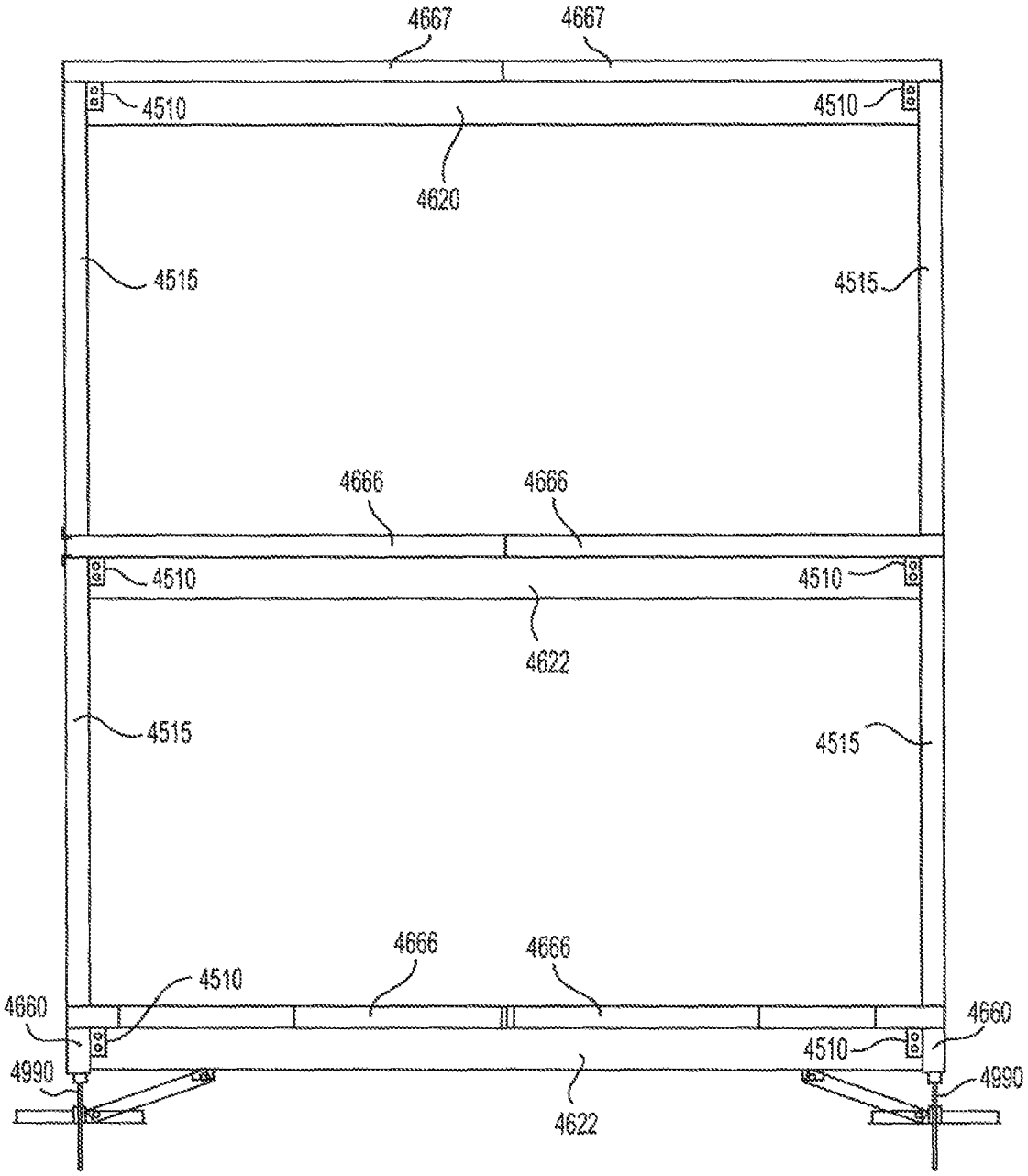
FIGS. 46A-E depict views of another embodiment of a two story relocatable structure.
Figure 46B:
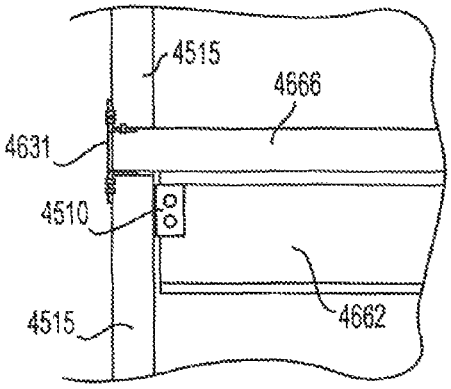
Figure 46C:
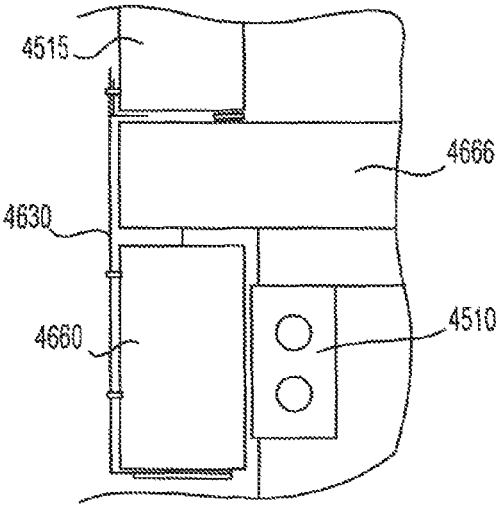
Figure 46D:
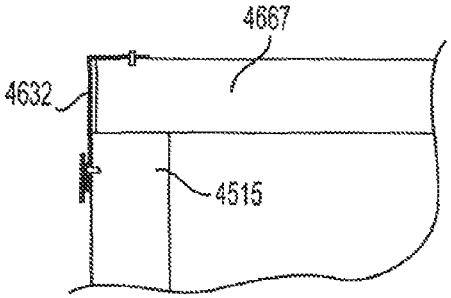
Figure 46E:
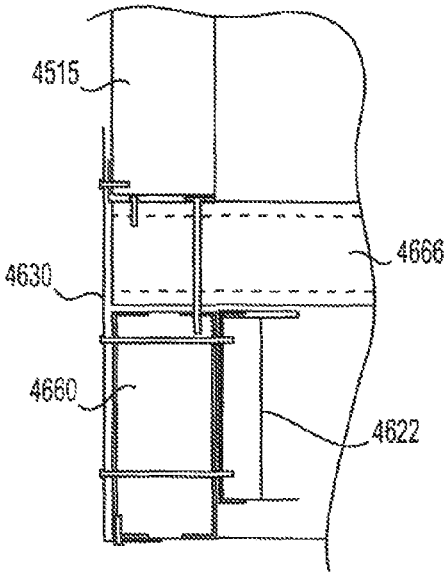

FIG. 45A and be depict perspective and side views of a load-distributing member 4510. Preferably, load-distributing member 4510 is an L shaped member adapted to be placed on an upper, interior edge of an exterior wall 4515. In a preferred embodiment, the exterior walls 4515 are load bearing while interior walls are not load bearing. However, in other embodiments, the interior walls are also load bearing and load-distributing member 4510 can be placed on an interior wall. Preferably, each load-distributing member 4510 extends the entire length of the exterior wall 4515 upon which the load-distributing member 4510 is placed, or a portion thereof. Load-distributing member 4510 may have one or more predrilled holes for inserting screws or bolts to secure load-distributing member 4510 to exterior wall 4515. In other embodiments, load-distributing member 4510 may couple to exterior wall 4515 with snaps, adhesive, toggles, clips, friction, cotter pins, or another fastening device. Additionally, as shown in FIG. 46C, load-distributing member 4510 can also be used to support a floor panel by being placed on top a support panel and floor support members being attached to the load-distributing members.

Figure 45B:
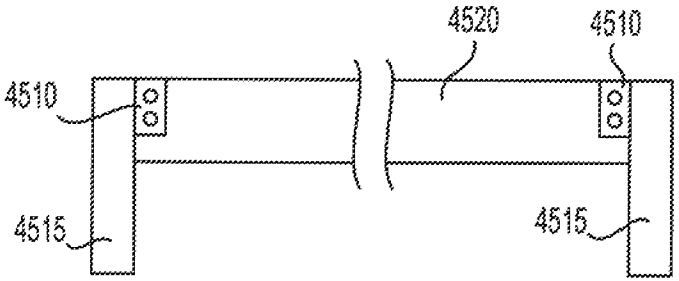

Preferably, load-distributing member 4510 has one or more tabs 4525 welded to an interior facing surface. Alternatively, tabs 4525 may be cut and bent out of load-distributing member 4510 or affixed to load-distributing member 4510 in another manner. Each tab 4525 preferably has one or more predrilled holes 4530 to secure a roof support 4520 to load-distributing member 4510. As shown in FIG. 45B, preferably two load-distributing members 4510 are placed on opposing exterior walls 4515 such that a roof support 4520 can be hung between the two load-distributing member 4510. Load-distributing member 4510 may also support interior walls. Preferably, load-distributing members 4510 allow panels to be moved around and can provide for an opening up to 6' under a portion of load-distributing members 4510.

FIGS. 46A-E depict views of a temporary, reloadable structure built utilizing load-distributing members 4510. The structure is supported by a number of adjustable supports 4990. Atop adjustable supports 4990 are support or skirt panels 4660 and floor support members 4622. Floor support members 4622 are preferably hung between two opposing load-distributing members 4510 coupled to the support panels 4660. Floor panels 4666 are preferably supported by support panels 4660 and floor support members 4665. Atop floor panels 4666 are preferably placed exterior walls 4515. Exterior walls 4515, floor panels 4660 and support panels 4660 may be coupled together with a bracket 4630. Atop exterior walls 4515 is preferably coupled another set of load-distributing members 4510. The load-distributing member 4510 may support floor support members 4665 for another floor, as shown in the figures for a two story building, or may support roof support members 4620 to support roof panels 4667, for a one story building. The building can be any number of stories, as required by the installation location and purpose. In multi-story buildings, a bracket 4631 may be used to couple a lower story to an upper story. Preferably, roof brackets 4632 are used to couple the roof panels to the exterior wall panels. Preferably, the brackets described herein are both structural and decorative, providing an exterior facade to hide the joining of the various parts the brackets couple together.

Figure 47:
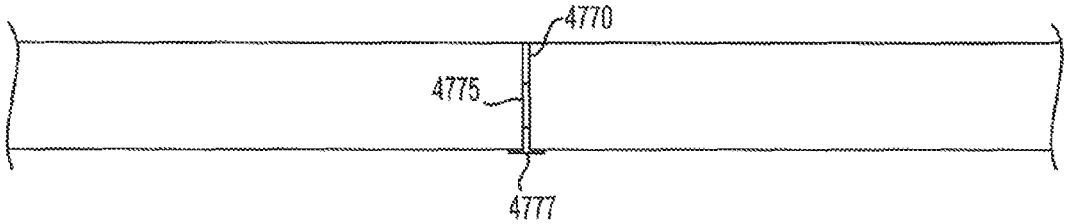
FIG. 47 depicts an embodiment of a joint between two panels.

Preferably, the panels are coupled together via butt joints, as shown in FIG. 47. However, other types of joints can be used to couple abutting panels. Preferably, between each panel is an expanding gasket 4770. Gasket 4770 is preferably airtight and watertight and is placed in the exterior gap between abutting panels. Fire tape 4775 may also be placed within the gaps of abutting panels. In other embodiments, other fire retardants and/or insulators may be placed between abutting panels. Decorative trim 4777 may be inserted into the interior gap between abutting panels to provide a finished appearance.

Figure 48:
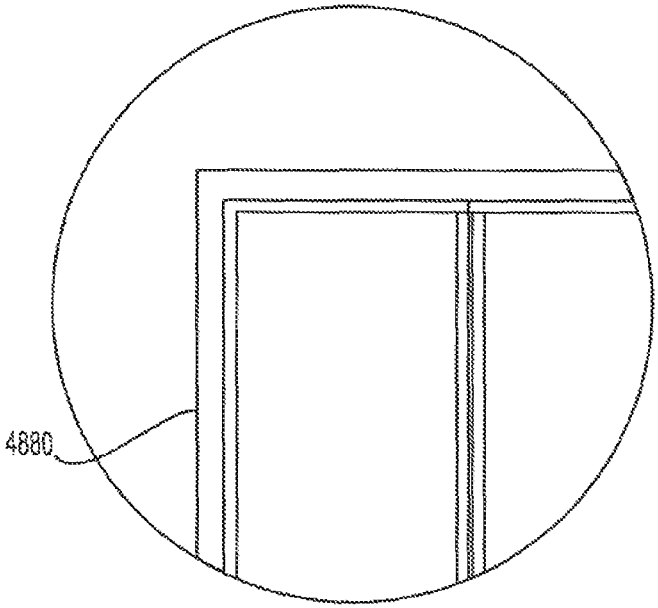
FIG. 48 depicts an embodiment of a roof joint seal.
Figure 49A:
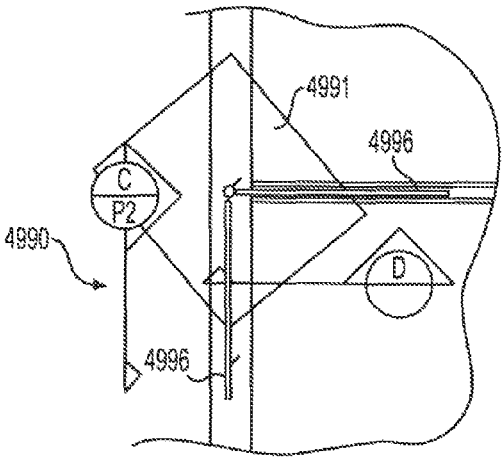
FIGS. 49A-D depict another embodiment of an adjustable structure support.
Figure 49B:
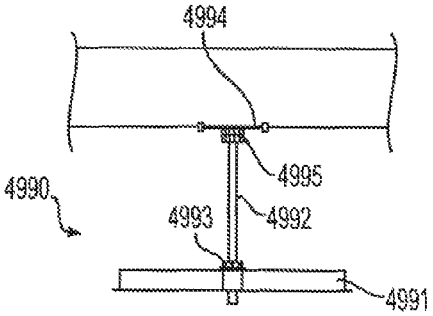
Figure 49C:
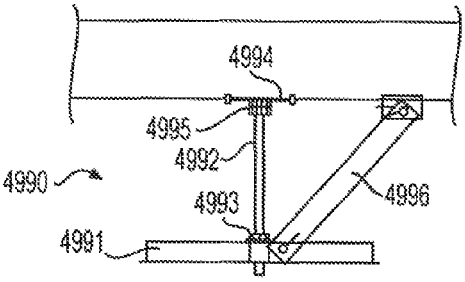
Figure 49D:
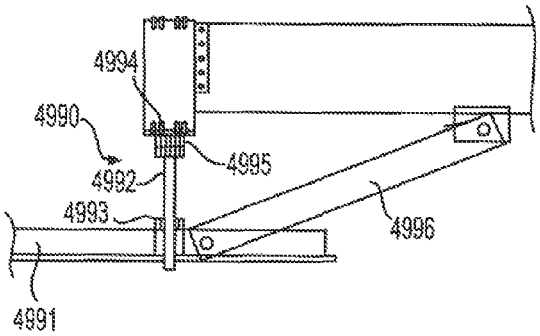

FIG. 48 depicts a corner of a roof. Preferably, the roof panels are sealed to external elements. For example, a coating of PVC 4880 can be chemically welded to the edges of the roof panels. Preferably, the PVC coating of the roof panels is welded to PVC coating 4880. In other embodiments, the PVC coating 4880 can be melted onto the edges of the roof panels. Preferably, the PVC coating 4880 can be cut during disassembly and a new PVC coating 4880 can be added during reassembly. Preferably PVC coating 4880 is a thin layer of PVC, for example less than 50 mil, less than 30 mil, or 20 mil or less.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising" includes the terms "consisting of" and "consisting essentially of," and the terms comprising, including, and containing are not intended to be limiting.

The invention claimed is:

1. A system for constructing a reassemblable structure, comprising:
- a plurality of wall panels;
- a plurality of roof panels;
- a plurality of floor panels;
- at least one readjustable support device, adapted to be adjusted to multiple positions;
- a plurality of skirt panels positioned between at least one floor panel and the at least one readjustable support device;
- a plurality of load-bearing members coupled to at least one wall panel;
- a plurality of load-bearing members coupled to at least one skirt panel;
- at least one floor support, positioned between at least two skirt panels, supported by two load-bearing members coupled to skirt panels and supporting the plurality of floor panels; and
- at least one roof support, positioned between at least two wall panels, supported by two load-bearing members coupled to wall panels and supporting the plurality of roof panels.

2. The system of claim 1, further comprising at least one floor coupling bracket, the at least one floor coupling bracket securing an outer surface of one of the plurality of wall panels, to one of the plurality of floor panels, and to the at least one skirt panel.

3. The system of claim 1, further comprising at least one tie-down coupled to the reassemblable structure.

4. The system of claim 1, wherein the floor supports and the roof supports are coupled to the load-bearing members by tabs extending from a surface of the load-bearing members.

5. The system of claim 1, wherein the wall panels comprise exterior wall panels and interior wall panels and the exterior wall panels are load bearing and the interior wall panels are non-load bearing.

6. The system of claim 1, wherein the system is adapted to be assembled and disassembled into original components on location, the original components are adapted to be moved to a second location, and the structure is adapted to be reassembled from the original components at the second location.

7. The system of claim 6, wherein the system is adapted to be re-located and reassembled after being disassembled multiple times.

8. The system of claim 1, further comprising watertight and airtight expanding gaskets positioned between panels.

9. The system of claim 1, wherein the reassemblable structure is a multi-story structure.

10. The system of claim 9, wherein the roof panels of the first story are the floor panels of the second story.

11. The system of claim 9, further comprising level coupling brackets coupling an outer surface of at least one wall panel of a lower level to an outer surface of at least one wall panel of an upper level.

12. The system of claim 1, wherein the wall panels are fire retardant.

13. The system of claim 1, further comprising a PVC roof seal chemically welded to the roof panels.

14. The system of claim 1, further comprising interior wall panels, wherein the interior wall panels divide the reassemblable structure into a plurality of rooms.

15. The system of claim 1, wherein adjacent panels are coupled together with shiplap joints or butt joints.

16. The system of claim 1, wherein the entire system is arrangeable within a single shipping container.

17. The system of claim 1, wherein at least a portion of the panels and the load-bearing members are predrilled to accept a screw.

18. The system of claim 1, wherein multiple reassemblable structures are arranged side-by-side to create a larger structure.

19. The system of claim 1, further comprising:

a first interlocking track coupled to a first edge of each wall panel, each roof panel, and each floor panel, wherein each first interlocking track comprises an angled recessed portion along an outer edge;

a second interlocking track coupled to a second, parallel edge, of each wall panel, each roof panel, and each floor panel, wherein the second interlocking track comprises an angled hemmed tab along a first outer edge adapted to mate with the angled recessed portion of the first interlocking track and a straight hemmed tab along a second, parallel outer edge; and at least one coupling bracket, the at least one coupling bracket coupling one of the plurality of wall panels, to one of the plurality of floor panels wherein, each floor coupling bracket is adapted to mate with the angled recessed portion of the first interlocking track and be coupled to the straight hemmed tab of the second interlocking track.

20. The system of claim 1, wherein the load bearing members are coupled to an upper, interior facing surface of the wall panels and the skirt panels.

21. The system of claim 20, wherein each floor coupling bracket is coupled to an outer surface of the structure.

* * * * *